US011953003B2

(12) United States Patent
Jo et al.

(10) Patent No.: US 11,953,003 B2
(45) **Date of Patent: *Apr. 9, 2024**

(54) SCROLL COMPRESSOR HAVING AT LEAST ONE VALVE FIXEDLY INSERTED INTO BLOCK INSERTION GROOVE OF NON-ORBITING SCROLL

(71) Applicant: LG ELECTRONICS INC., Seoul (KR)

(72) Inventors: Changeol Jo, Seoul (KR); Jeonghun Kim, Seoul (KR); Nara Han, Seoul (KR); Juhwan Yun, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

This patent is subject to a terminal disclaimer.

(21) Appl. No.: 18/100,712

(22) Filed: Jan. 24, 2023

(65) Prior Publication Data

US 2023/0400022 A1 Dec. 14, 2023

(30) Foreign Application Priority Data

Jun. 9, 2022 (KR) ..... 10-2022-0070269

(51) Int. Cl.
*F04C 18/02* (2006.01)
*F04C 28/26* (2006.01)
*F04C 29/12* (2006.01)

(52) U.S. Cl.
CPC ..... *F04C 18/0215* (2013.01); *F04C 28/26* (2013.01); *F04C 29/124* (2013.01); *F04C 29/128* (2013.01)

(58) Field of Classification Search
CPC ..... F04C 2/025; F04C 18/0215–0292; F04C 14/26–265; F04C 15/06–068;
(Continued)

(56) References Cited

U.S. PATENT DOCUMENTS 11,781,546 B1 * 10/2023 Jo ..... F04C 18/0215 418/55.1
2015/0345493 A1 * 12/2015 Lochner ..... F04C 29/128 418/55.5

(Continued)

FOREIGN PATENT DOCUMENTS

CN 204511881 7/2015
CN 108240337 A * 7/2018 ..... F04C 18/0223

(Continued)

OTHER PUBLICATIONS

Korean Office Action issued in Application No. 10-2022-0070269 dated Oct. 12, 2023.

*Primary Examiner* — Laert Dounis
(74) *Attorney, Agent, or Firm* — KED & ASSOCIATES, LLP

(57) ABSTRACT

A scroll compressor is provided, the scroll compressor having a block insertion groove recessed by a predetermined depth into a rear surface of a non-orbiting scroll to accommodate a discharge port and a plurality of bypass holes, and a retainer block having a bypass valve that opens and closes the plurality of bypass holes fixedly inserted into the block insertion groove. The bypass valve may be fixed to a first axial side surface of the retainer block facing the block insertion groove. Through this, the bypass valve that suppresses or prevents overcompression of a compression chamber is not fastened to a non-orbiting end plate, which may allow the non-orbiting end plate to be reduced in thickness. This may shorten lengths of the plurality of bypass holes and the discharge port by the reduced thickness of the non-orbiting end plate, thereby decreasing a dead volume in the plurality of bypass holes and the discharge port.

16 Claims, 23 Drawing Sheets

(58) Field of Classification Search
CPC ..... F04C 28/26; F04C 28/265; F04C 29/12–128; F01C 1/0215–0292; F01C 20/26–265; F01C 21/18–186
See application file for complete search history.

(56) References Cited

U.S. PATENT DOCUMENTS

| | | | | |
|---|---|---|---|---|
| 2016/0201673 | A1* | 7/2016 | Perevozchikov | F04C 28/24 137/527 |
| 2018/0038370 | A1 | 2/2018 | Doepker et al. | |
| 2022/0136501 | A1* | 5/2022 | Yun | F04C 18/0253 418/55.2 |
| 2022/0235774 | A1* | 7/2022 | Cui | F04C 18/0215 |

FOREIGN PATENT DOCUMENTS

| | | | | |
|---|---|---|---|---|
| CN | 207960933 | | 10/2018 | |
| KR | 10-2014-0114212 | | 9/2014 | |
| KR | 10-2015-0126533 | | 11/2015 | |
| KR | 10-2017-0007374 | | 1/2017 | |
| KR | 20200053989 | A * | 5/2020 | |
| WO | WO-2019128793 | A1 * | 7/2019 | |
| WO | WO-2019134654 | A1 * | 7/2019 | F04C 18/02 |

* cited by examiner

SCROLL COMPRESSOR HAVING AT LEAST ONE VALVE FIXEDLY INSERTED INTO BLOCK INSERTION GROOVE OF NON-ORBITING SCROLL

CROSS-REFERENCE TO RELATED APPLICATION(S)

Pursuant to 35 U.S.C. § 119(a), this application claims the benefit of the earlier filing date and the right of priority to Korean Patent Application No. 10-2022-0070269, filed in Korea on Jun. 9, 2022, the contents of which are incorporated by reference herein in their entirety.

BACKGROUND

1. Field

A scroll compressor is disclosed herein.

2. Background

A scroll compressor is configured such that an orbiting scroll and a non-orbiting scroll are engaged with each other and a pair of compression chambers is formed between the orbiting scroll and the non-orbiting scroll while the orbiting scroll performs an orbiting motion with respect to the non-orbiting scroll. Each compression chamber includes a suction pressure chamber formed at an outer side, an intermediate pressure chamber continuously formed toward a central portion from the suction pressure chamber while gradually decreasing in volume, and a discharge pressure chamber connected to a center of the intermediate pressure chamber. Typically, the suction pressure chamber communicates with a refrigerant suction pipe through a side surface of the non-orbiting scroll, the intermediate pressure chamber is sealed and connected in multiple stages, and the discharge pressure chamber communicates with a refrigerant discharge pipe through a center of an end plate of the non-orbiting scroll.

The scroll compressor is configured so that the compression chamber continuously moves, which may cause overcompression during operation. Accordingly, in the related art scroll compressor, a bypass hole is formed around a discharge port, that is, at an upstream side of the discharge port to discharge overcompressed refrigerant in advance. A bypass valve is disposed in the bypass hole to open and close the bypass hole according to pressure in the compression chamber. A plate valve or a reed valve is mainly applied as the bypass valve.

U.S. Patent Publication No. 2018/0038370 (hereinafter "Patent Document 1"), which is hereby incorporated by reference, discloses a scroll compressor to which a bypass valve configured as a plate valve is applied. Patent Document 1 discloses that a single bypass valve in an annular shape opens and closes a plurality of bypass holes, but this increases the number of components as the bypass valve is supported by an elastic member. In addition, as the bypass valve operates in a separated state, it is difficult to modularize the bypass valve, which may increase the number of assembly processes of the compressor. As a length of the bypass hole increases, not only overcompression due to discharge delay occurs, but also a dead volume increases, which may decrease indicated efficiency.

Korean Patent Publication No. 10-2014-0114212 (hereinafter "Patent Document 2"), which is hereby incorporated by reference, and U.S. Patent Publication No. 2015/0345493

(hereinafter "Patent Document 3"), which is hereby incorporated by reference, each discloses a scroll compressor to which a bypass valve configured as a reed valve is applied. In Patent Document 2 and Patent Document 3, the bypass valve is fixed to a non-orbiting scroll using a rivet or pin. For this, an end plate of the non-orbiting scroll should be as thick as a rivet depth or a pin depth, which causes an increase in length of the bypass hole. As a result, as in Patent Document 1, refrigerant discharge through the bypass hole is delayed and thereby the refrigerant is overcompressed. In addition, a dead volume increases due to the increased length of the bypass hole, causing indicated efficiency to be degraded.

BRIEF DESCRIPTION OF THE DRAWINGS

Embodiments will be described in detail with reference to the following drawings in which like reference numerals refer to like elements, and wherein.

DETAILED DESCRIPTION

Figure 1:
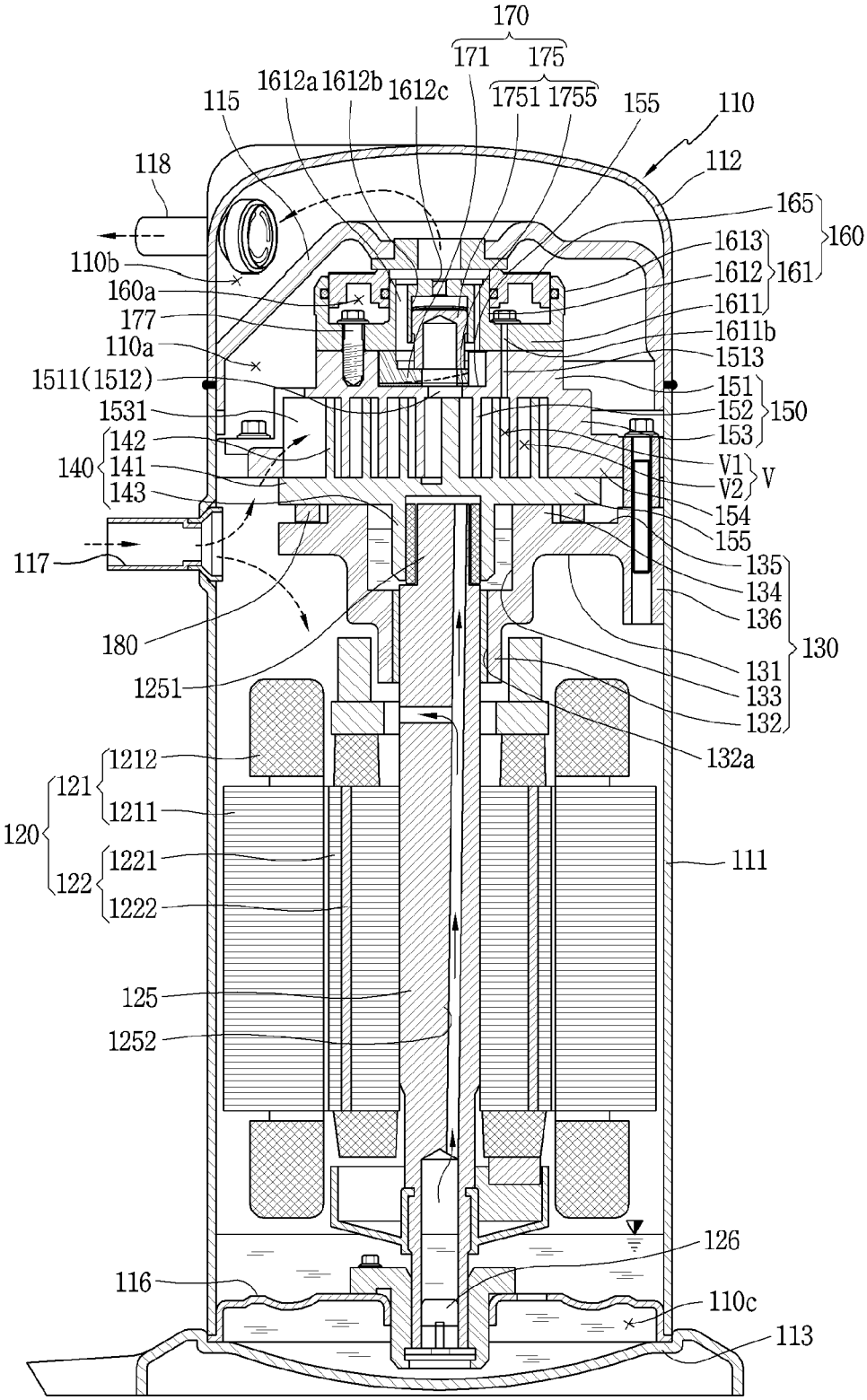
FIG. 1 is a longitudinal cross-sectional view illustrating an inner structure of a capacity-variable scroll compressor in accordance with an embodiment.

Description will now be given of a scroll compressor according to embodiments disclosed herein, with reference to the accompanying drawings.

Typically, a scroll compressor may be classified as an open type or a hermetic type depending on whether a drive (motor) and a compression part or portion are all installed in an inner space of a casing. The former is a compressor in which the motor configuring the drive is provided separately from the compression portion, and the latter hermetic type is a compressor in which both the motor and the compression are disposed inside of the casing. Hereinafter, a hermetic type scroll compressor will be described as an example, but it is not necessarily limited to the hermetic scroll compressor. In other words, embodiments may be equally applied even to the open type scroll compressor in which the motor and the compression portion are disposed separately from each other.

A scroll compressor is also classified as a low-pressure type compressor or a high-pressure type compressor depending on what type of pressure is defined in an inner space of a casing, specifically, a space accommodating the motor in a hermetic scroll compressor. In the former, the space defines a low-pressure part or portion and a refrigerant suction pipe communicates with the space. On the other hand, in the latter, the space defines a high-pressure part or portion and the refrigerant suction pipe is directly connected to the compression portion through the casing. Hereinafter, a low-pressure type scroll compressor according to an embodiment will be described as an example. However, embodiments are not limited to the low-pressure type scroll compressor.

In addition, scroll compressors may be classified into a vertical scroll compressor in which a rotary shaft is disposed perpendicular to the ground and a horizontal (lateral) scroll compressor in which the rotary shaft is disposed parallel to the ground. For example, in the vertical scroll compressor, an upper side may be defined as an opposite side to the ground and a lower side may be defined as a side facing the ground. Hereinafter, the vertical scroll compressor will be described as an example. However, embodiments may also be equally applied to the horizontal scroll compressor. Hereinafter, it will be understood that an axial direction is an axial direction of the rotary shaft, a radial direction is a radial direction of the rotary shaft, the axial direction is an upward and downward direction, the radial direction is a left and right or lateral direction, and an inner circumferential surface is an upper surface, respectively.

In addition, scroll compressors may be mainly divided into a tip seal type and a back pressure type depending on a method of sealing between compression chambers. The back pressure type may be divided into an orbiting back pressure type of pressing an orbiting scroll toward a non-orbiting scroll, and a non-orbiting back pressure type of pressing the non-orbiting scroll toward the orbiting scroll. Hereinafter, a scroll compressor to which a non-orbiting back pressure type is applied will be described as an example. However, embodiments may also be applied to the tip seal type as well as the orbiting back pressure type.

Figure 2:
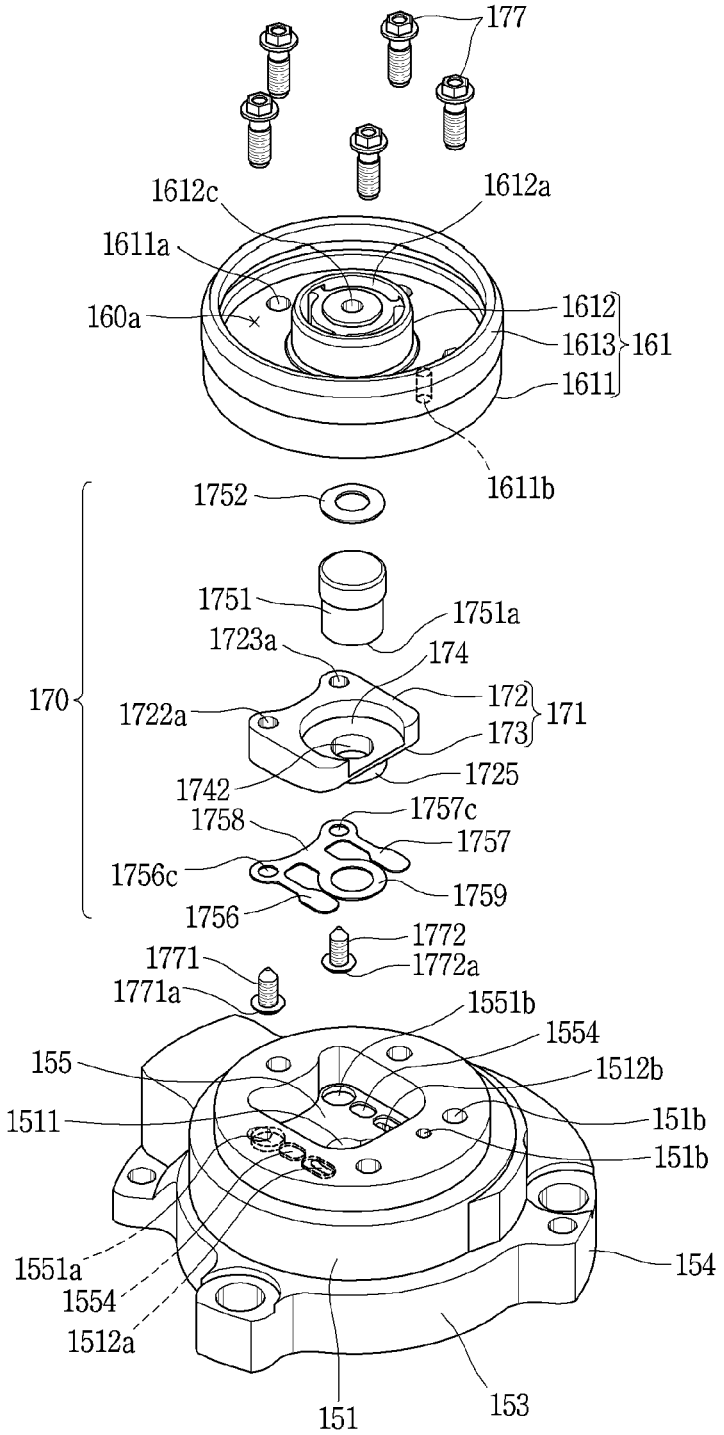
FIG. 2 is an exploded perspective view of a portion of a compression portion in FIG. 1.

FIG. 1 is a longitudinal cross-sectional view illustrating an inner structure of a capacity-variable scroll compressor in accordance with an embodiment. FIG. 2 is an exploded perspective view illustrating a portion of a compression portion in FIG. 1.

A scroll compressor according to an embodiment may include a drive motor 120 constituting a motor disposed in a lower half portion of a casing 110, and a main frame 130, an orbiting scroll 140, a non-orbiting scroll 150, a back pressure chamber assembly 160, and a valve assembly 170 that constitute a compression part or portion disposed above the drive motor 120. The motor is coupled to one (first) end of a rotary shaft 125, and the compression portion is coupled to another (second) end of the rotary shaft 125. Accordingly, the compression portion may be connected to the motor by the rotary shaft 125 to be operated by a rotational force of the motor.

Referring to FIG. 1, the casing 110 according to embodiment may include a cylindrical shell 111, an upper cap 112, and a lower cap 113. The cylindrical shell 111 has a cylindrical shape with upper and lower ends open, and the drive motor 120 and the main frame 130 may be fitted on an inner circumferential surface of the cylindrical shell 111. A terminal bracket (not illustrated) may be coupled to an upper half portion of the cylindrical shell 111. A terminal (not illustrated) that transmits external power to the drive motor 120 may be coupled through the terminal bracket. In addition, a refrigerant suction pipe 117 described hereinafter may be coupled to the upper portion of the cylindrical shell 111, for example, above the drive motor 120.

The upper cap 112 may be coupled to cover an upper opening of the cylindrical shell 111. The lower cap 113 may be coupled to cover a lower opening of the cylindrical shell 111. A rim of a high/low pressure separation plate 115 described hereinafter may be inserted between the cylindrical shell 111 and the upper cap 112 to be, for example, welded on the cylindrical shell 111 and the upper cap 112. A rim of a support bracket 116 described hereinafter may be inserted between the cylindrical shell 111 and the lower cap 113 to be, for example, welded on the cylindrical shell 111 and the lower cap 113. Accordingly, the inner space of the casing 110 may be sealed.

The rim of the high/low pressure separation plate 115 may be welded on the casing 110 as described above. A central portion of the high/low pressure separation plate 115 may be bent and protrude toward an upper surface of the upper cap 112 so as to be disposed above the back pressure chamber assembly 160 described hereinafter. A refrigerant suction pipe 117 communicates with a space below the high/low pressure separation plate 115, and a refrigerant discharge pipe 118 communicates with a space above the high/low pressure separation plate 115. Accordingly, a low-pressure part or portion 110*a* constituting a suction space may be formed below the high/low pressure separation plate 115, and a high-pressure part or portion 110*b* constituting a discharge space may be formed above the high/low pressure separation plate 115.

In addition, a through hole 115*a* may be formed through a center of the high/low pressure separation plate 115. A sealing plate 1151 from which a floating plate 165 described hereinafter is detachable may be inserted into the through hole 115*a*. The low-pressure portion 110*a* and the high-pressure portion 110*b* may be blocked from each other by attachment/detachment of the floating plate 165 and the sealing plate 1151 or may communicate with each other through a high/low pressure communication hole 1151*a* of the sealing plate 1151.

In addition, the lower cap 113 may define an oil storage space 110*c* together with the lower portion of the cylindrical shell 111 constituting the low-pressure portion 110*a*. In other words, the oil storage space 110*c* is defined in the lower portion of the low-pressure portion 110*a*. The oil storage space 110*c* thus defines a portion of the low-pressure portion 110*a*.

Referring to FIG. 1, the drive motor 120 according to an embodiment is disposed in a lower half portion of the low-pressure portion 110*a* and may include a stator 121 and a rotor 122. The stator 121 may be, for example, shrink-fitted to an inner wall surface of the casing 111, and the rotor 122 may be rotatably provided inside of the stator 121. The stator 121 may include a stator core 1211 and a stator coil 1212.

The stator core 1211 may be formed in a cylindrical shape and may be shrink-fitted onto an inner circumferential surface of the cylindrical shell 111. The stator coil 1212 may be wound around the stator core 1211 and may be electrically connected to an external power source through a terminal (not illustrated) that is coupled through the casing 110.

The rotor 122 may include a rotor core 1221 and permanent magnets 1222. The rotor core 1221 may be formed in a cylindrical shape, and be rotatably inserted into the stator core 1211 with a preset or predetermined gap therebetween. The permanent magnets 1222 may be embedded in the rotor core 1222 at preset intervals along a circumferential direction.

In addition, the rotary shaft 125 may be press-fitted to a center of the rotor core 1221. An orbiting scroll 140 described hereinafter may be eccentrically coupled to an upper end of the rotary shaft 125. Accordingly, the rotational force of the drive motor 120 may be transmitted to the orbiting scroll 140 through the rotary shaft 125.

An eccentric portion 1251 that is eccentrically coupled to the orbiting scroll 140 described hereinafter may be formed on an upper end of the rotary shaft 125. An oil pickup 126 that suctions up oil stored in the lower portion of the casing 110 may be disposed in or at a lower end of the rotary shaft 125. An oil passage 1252 may be formed through an inside of the rotary shaft 125 in the axial direction.

Referring to FIG. 1, the main frame 130 may be disposed on an upper side of the drive motor 120, and may be, for example, shrink-fitted to or welded on an inner wall surface of the cylindrical shell 111. The main frame 130 may include a main flange portion (main flange) 131, a main bearing portion (main bearing) 132, an orbiting space portion (orbiting space) 133, a scroll support portion (scroll support) 134, an Oldham ring support portion (Oldham ring support) 135, and a frame fixing portion 136.

The main flange portion 131 may be formed in an annular shape and accommodated in the low-pressure portion 110*a* of the casing 110. An outer diameter of the main flange portion 131 may be smaller than an inner diameter of the cylindrical shell 111 so that an outer circumferential surface of the main flange portion 131 is spaced apart from an inner circumferential surface of the cylindrical shell 111. However, the frame fixing portion 136 described hereinafter may protrude from an outer circumferential surface of the main flange portion 131 in the radial direction. An outer circumferential surface of the frame fixing portion 136 may be fixed in close contact with the inner circumferential surface of the casing 110. Accordingly, the main frame 130 may be fixedly coupled to the casing 110.

The main bearing portion 132 may protrude downward from a lower surface of a central part or portion of the main flange portion 131 toward the drive motor 120. A bearing hole 132*a* formed in a cylindrical shape may penetrate through the main bearing portion 132 in the axial direction. The rotary shaft 125 may be inserted into an inner circumferential surface of the bearing hole 132*a* and supported in the radial direction.

The orbiting space portion 133 may be recessed from the center portion of the main flange portion 131 toward the main bearing portion 132 to have a predetermined depth and outer diameter. The outer diameter of the orbiting space portion 133 may be larger than an outer diameter of a rotary shaft coupling portion 143 that is disposed on the orbiting scroll 140 described hereinafter. Accordingly, the rotary shaft coupling portion 143 may be pivotally accommodated in the orbiting space portion 133.

The scroll support portion 134 may be formed in an annular shape on an upper surface of the main flange portion 131 along a circumference of the orbiting space portion 133. Accordingly, the scroll support portion 134 may support the lower surface of an orbiting end plate 141 described hereinafter in the axial direction.

The Oldham ring support portion 135 may be formed in an annular shape on an upper surface of the main flange portion 131 along an outer circumferential surface of the scroll support portion 134. Accordingly, an Oldham ring 180 may be inserted into the Oldham ring supporting portion 135 to be pivotable.

The frame fixing portion 136 may extend radially from an outer circumference of the Oldham ring support portion 135. The frame fixing portion 136 may extend in an annular shape or extend to form a plurality of protrusions spaced apart from one another by preset or predetermined distances. This embodiment illustrates an example in which the frame fixing portion 136 includes a plurality of protrusions along the circumferential direction.

Referring to FIG. 1, the orbiting scroll 140 according to an embodiment is coupled to the rotary shaft 125 to be disposed between the main frame 130 and the non-orbiting scroll 150. The Oldham ring 180, which is an anti-rotation mechanism, is disposed between the main frame 130 and the orbiting scroll 140. Accordingly, the orbiting scroll 140 performs an orbiting motion relative to the non-orbiting scroll 150 while its rotational motion is restricted.

The orbiting scroll 140 may include orbiting end plate 141, an orbiting wrap 142, and rotary shaft coupling portion 143. The orbiting end plate 141 is formed approximately in a disk shape. An outer diameter of the orbiting end plate 141 may be mounted on the scroll support portion 134 of the main frame 130 to be supported in the axial direction. Accordingly, the orbiting end plate 141 and the scroll support portion 134 facing it defines an axial bearing surface (no reference numeral given).

The orbiting wrap 142 is formed in a spiral shape by protruding from an upper surface of the orbiting end plate 141 facing the non-orbiting scroll 150 to a preset or predetermined height. The orbiting wrap 142 is formed to correspond to the non-orbiting wrap 152 to perform an orbiting motion by being engaged with a non-orbiting wrap 152 of the non-orbiting scroll 150 described hereinafter. The orbiting wrap 142 defines compression chambers V together with the non-orbiting wrap 152.

The compression chambers V may include first compression chamber V1 and second compression chamber V2 based on the orbiting wrap 142. Each of the first compression chamber V1 and the second compression chamber V2 may include a suction pressure chamber (not illustrated), an intermediate pressure chamber (not illustrated), and a discharge pressure chamber (not illustrated) that are continuously formed. Hereinafter, description will be given under the assumption that a compression chamber defined between an outer surface of the orbiting wrap 142 and an inner surface of the non-orbiting wrap 152 facing the same is defined as the first compression chamber V1, and a compression chamber defined between an inner surface of the orbiting wrap 142 and an outer surface of the non-orbiting wrap 152 facing the same is defined as the second compression chamber V2.

The rotary shaft coupling portion 143 may protrude from a lower surface of the orbiting end plate 141 toward the main frame 130. The rotary shaft coupling portion 143 may be formed in a cylindrical shape, so that an orbiting bearing (not illustrated) configured as a bush bearing may be press-fitted thereto.

Referring to FIGS. 1 and 2, the non-orbiting scroll 150 according to an embodiment may be disposed on an upper portion of the main frame 130 with the orbiting scroll 140 interposed therebetween. The non-orbiting scroll 150 may be fixedly coupled to the main frame 130 or may be coupled to the main frame 130 to be movable up and down. This embodiment illustrates an example in which the non-orbiting scroll 150 is coupled to the main frame 130 to be movable relative to the main frame 130 in the axial direction.

The non-orbiting scroll 150 according to this embodiment may include a non-orbiting end plate 151, non-orbiting wrap 152, a non-orbiting side wall portion (non-orbiting side wall) 153, and a guide protrusion 154. The non-orbiting end plate 151 may be formed in a disk shape and disposed in the lateral direction in the low-pressure portion 110*a* of the casing 110. A plurality of back pressure fastening grooves 151*b* may be formed along an edge of the non-orbiting end plate 151. Accordingly, fastening bolts 177 that pass through back pressure fastening holes 1611*a* of a back pressure plate 161 described hereinafter may be fastened to the back pressure fastening grooves 151*b* of the non-orbiting end plate 151, such that the back pressure plate 161 may be fastened to a rear surface (upper surface) 151*a* of the non-orbiting end plate 151.

A discharge port 1511, bypass holes 1512, and a first back pressure hole 1513 may be formed through a central portion of the non-orbiting end plate 151 in the axial direction. The discharge port 1511 may be disposed at a center of the non-orbiting end plate 151, the bypass holes 1512 may be located at an outer side, that is, an upstream side, of the discharge port 1511, and the first back pressure hole 1513 may be located at an outer side, that is, an upstream side, of the bypass hole 1512.

The discharge port 1511 may be located at a position of which a discharge pressure chamber (no reference numeral given) of the first compression chamber V1 and a discharge pressure chamber (no reference numeral given) of the second compression chamber V2 communicate with each other. Accordingly, refrigerant compressed in the first compression chamber V1 and refrigerant compressed in the second compression chamber V2 may be combined in the discharge pressure chamber and discharged to the high-pressure portion 110*b* as a discharge space through the discharge port 1511.

The bypass holes 1512 may include first bypass hole 1512*a* and second bypass hole 1512*b*. Each of the first bypass hole 1512*a* and the second bypass hole 1512*b* may be provided as a single hole or may be provided as a plurality. This embodiment illustrates an example in which each of the first bypass hole 1512*a* and the second bypass hole 1512*b* is provided as a plurality. Accordingly, the bypass holes may be formed to be smaller than a wrap thickness of the orbiting wrap 142 and also an entire area of the bypass holes 1512 may be enlarged.

The first bypass hole 1512*a* may communicate with the first compression chamber V1 and the second bypass hole 1512*b* may communicate with the second compression chamber V2. The first bypass hole 1512*a* and the second bypass hole 1512*b* may be formed at both sides of the discharge port 1511 in the circumferential direction with the discharge port 1511 located at the center, in other words, formed at a suction side rather than the discharge port 1511. Accordingly, when refrigerant is overcompressed in each of the compression chambers V1 and V2, the refrigerant may be bypassed in advance before reaching the discharge port 1511, thereby suppressing or preventing the overcompression.

Both the first bypass hole 1512*a* and the second bypass hole 1512*b* are accommodated in a block insertion groove 155 described hereinafter. In other words, the block insertion groove 155 may be recessed by a preset or predetermined depth into a rear surface 151*a* of the non-orbiting end plate 151, and the first bypass hole 1512*a* and the second bypass hole 1512*b* may be formed inside of the block insertion groove 155 together with the discharge port 1511. Accordingly, a length L2 of each of the first bypass hole 1512*a* and the second bypass hole 1512*b* may be reduced by a value obtained by subtracting a depth D1 of the block insertion groove 155 from a thickness H1 of the non-orbiting end plate 151, which may result in decreasing dead volumes in the first bypass hole 1512*a* and the second bypass hole 1512*b*. The block insertion groove 155 will be described hereinafter together with retainer block 171.

The first back pressure hole 1513 may be formed through the non-orbiting end plate 151 in the axial direction, so as to communicate with a compression chamber V that forms an intermediate pressure between a suction pressure and a discharge pressure. The first back pressure hole 1513 may be provided as one to communicate with any one of the first compression chamber V1 or the second compression chamber V2, or may be provided as a plurality to communicate with both of the first and second compression chambers V1 and V2, respectively.

The non-orbiting wrap 152 may extend axially from a lower surface of the non-orbiting end plate 151. The non-orbiting wrap 152 may be formed in a spiral shape inside of the non-orbiting side wall portion 153 to correspond to the orbiting wrap 142 so as to be engaged with the orbiting wrap 142.

The non-orbiting side wall portion 153 may extend in an annular shape from a rim of a lower surface of the non-orbiting end plate 151 in the axial direction to surround the non-orbiting wrap 152. A suction port 1531 may be formed through one side of an outer circumferential surface of the non-orbiting side wall portion 153 in the radial direction. Accordingly, each of the first compression chamber V1 and the second compression chamber V2 compresses suctioned refrigerant as its volume decreases from an outer side to a center.

The guide protrusion 154 may extend radially from an outer circumferential surface of a lower side of the non-orbiting side wall portion 153. The guide protrusion 154 may be formed as a single annular shape or may be provided as a plurality disposed at preset or predetermined distances in the circumferential direction. This embodiment will be mainly described based on an example in which a plurality of guide protrusions 154 is disposed at preset or predetermined distances along the circumferential direction.

Referring to FIG. 1, the back pressure chamber assembly 160 according to an embodiment may be disposed at an upper side of the non-orbiting scroll 150. Accordingly, back pressure of a back pressure chamber 160*a* (to be precise, a force that the back pressure applies to the back pressure chamber) is applied to the non-orbiting scroll 150. In other words, the non-orbiting scroll 150 is pressed toward the orbiting scroll 140 by the back pressure to seal the compression chambers V1 and V2.

The back pressure chamber assembly 160 may include back pressure plate 161 and floating plate 165. The back pressure plate 161 may be coupled to an upper surface of the non-orbiting end plate 151. The floating plate 165 may be slidably coupled to the back pressure plate 161 to define the back pressure chamber 160*a* together with the back pressure plate 161.

The back pressure plate 161 may include a fixed plate portion (fixed plate) 1611, a first annular wall portion (first annular wall) 1612, and a second annular wall portion (second annular wall) 1613. The fixed plate portion 1611 may be in the form of an annular plate with a hollow center. A plurality of back pressure fastening holes 1611*a* may be formed along an edge of the fixed plate portion 1611. Accordingly, the fixed plate portion 1611 may be fastened to the non-orbiting scroll 150 by the fastening bolts 177 inserted through the back pressure fastening holes 1611*a*.

A plate-side back pressure hole (hereinafter, referred to as a "second back pressure hole") 1611*b* may be formed through the fixed plate portion 1611 in the axial direction. The second back pressure hole 1611*a* may communicate with the compression chamber V through the first back pressure hole 1513. Accordingly, the compression chamber V and the back pressure chamber 160*a* may communicate with each other through the second back pressure hole 1611*a* as well as the first back pressure hole 1513.

The first annular wall portion 1612 and the second annular wall portion 1613 may be formed on an upper surface of the fixed plate portion 1611 to surround inner and outer circumferential surfaces of the fixed plate portion 1611. Accordingly, the back pressure chamber 160*a* formed in the annular shape may be defined by an outer circumferential surface of the first annular wall portion 1612, an inner circumferential surface of the second annular wall portion 1613, the upper surface of the fixed plate portion 1611, and a lower surface of the floating plate 165.

The first annular wall portion 1612 may include an intermediate discharge port 1612*a* that communicates with the discharge port 1511 of the non-orbiting scroll 150. A valve guide groove 1612*b* into which a discharge valve 1751 may be slidably inserted may be formed at an inner side of the intermediate discharge port 1612*a*. A backflow prevention hole 1612*c* may be formed in a center of the valve guide groove 1612*b*. Accordingly, the discharge valve 1751 may be selectively opened and closed between the discharge port 1511 and the intermediate discharge port 1612*a* to suppress or prevent discharged refrigerant from flowing back into the compression chambers V1 and V2.

The floating plate 165 may be formed in an annular shape. The floating plate 165 may be formed of a lighter material than the back pressure plate 161. Accordingly, the floating plate 165 may be detachably coupled to a lower surface of the high/low pressure separation plate 115 while moving in the axial direction with respect to the back pressure plate 161 depending on the pressure of the back pressure chamber 160*a*. For example, when the floating plate 165 is brought into contact with the high/low pressure separation plate 115, the floating plate 165 serves to seal the low-pressure portion 110*a* such that the discharged refrigerant is discharged to the high-pressure portion 110*b* without leaking into the low-pressure portion 110*a*.

Referring to FIGS. 1 and 2, the back pressure chamber assembly 170 according to an embodiment may be disposed between the non-orbiting scroll 150 and the back pressure chamber assembly 160. The valve assembly 170 may be manufactured separately from the back pressure chamber assembly 160 to be fixed between the non-orbiting scroll 150 and the back pressure chamber assembly 160, or may be coupled to or integrally formed with the back pressure chamber assembly 160 to be fixed between the orbiting scroll 150 and the back pressure chamber assembly 160. In this embodiment, an example in which the valve assembly 170 is manufactured separately from the back pressure chamber assembly 160 and fixed between the non-orbiting scroll 150 and the back pressure chamber assembly 160 will be described first.

Also, the valve assembly 170 may include discharge valve 1751 and a bypass valve 1755, or may include only the bypass valve 1755 excluding the discharge valve 1751. However, depending on the shape of a discharge valve 1751, the discharge valve 1751 may also be described as being included in the valve assembly 170. For example, when the discharge valve 1751 is configured as a reed valve and fastened to retainer block 171, the discharge valve 1751 may also be described as being included in the valve assembly 170. In this embodiment, the discharge valve 1751 is slidably inserted into the valve guide groove 1612*b* that is disposed in the back pressure plate 161, and the bypass valve 1755 is fixed to the retainer block 171 described hereinafter. Thus, it will be described in this embodiment that only the bypass valve 1755 is included in the valve assembly 170.

In addition, the valve assembly 170 may be fixedly inserted into the block insertion groove 155 of the non-orbiting end plate 151. In other words, the block insertion groove 155 may not be included in the valve assembly 170 but is a portion into which the valve assembly 170 is inserted. Thus, in broad terms, the block insertion groove 155 may also be included in the valve assembly 170. Therefore, in the following description, the block insertion groove 155 will be described separately from the valve assembly 170, but the portion thereof that is related to the valve assembly 170 will also be described as a portion of the valve assembly 170.

Figure 3:
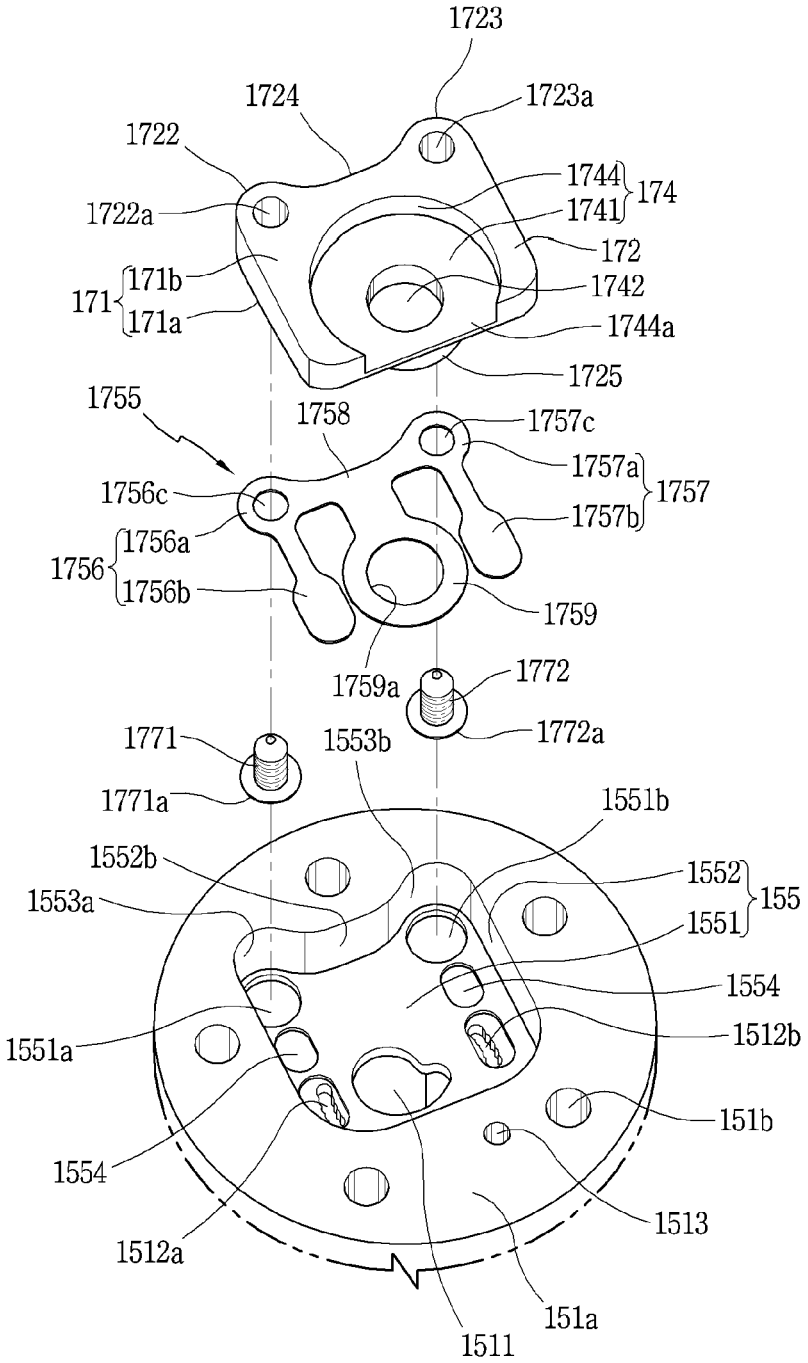
FIG. 3 is an exploded perspective view of a valve assembly of a non-orbiting scroll in FIG. 2.
Figure 4:
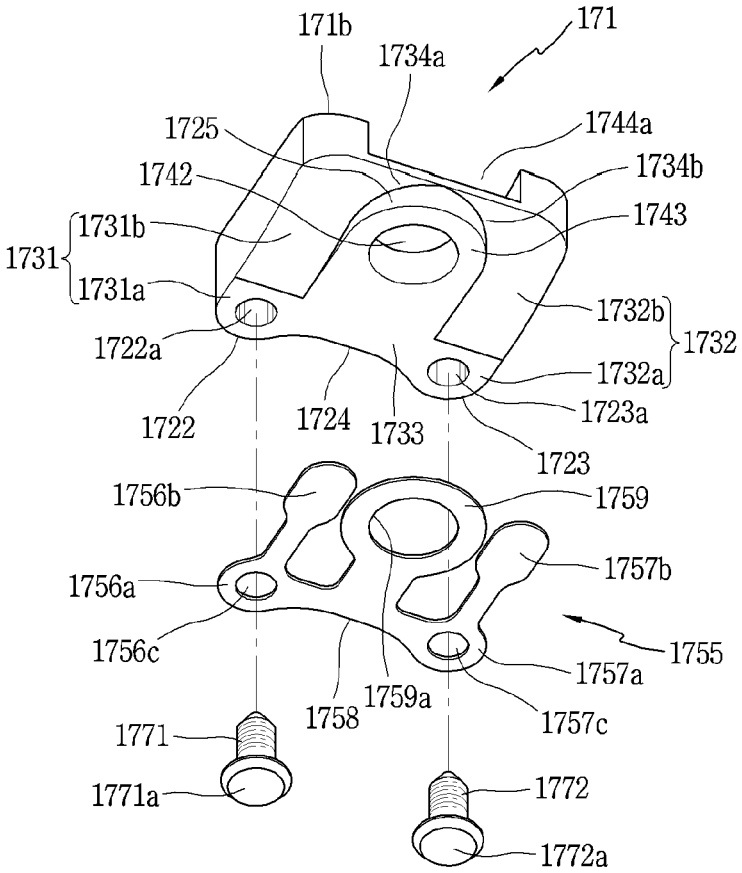
FIG. 4 is an exploded perspective view of the valve assembly of FIG. 3 from a first axial side surface.
Figure 5:
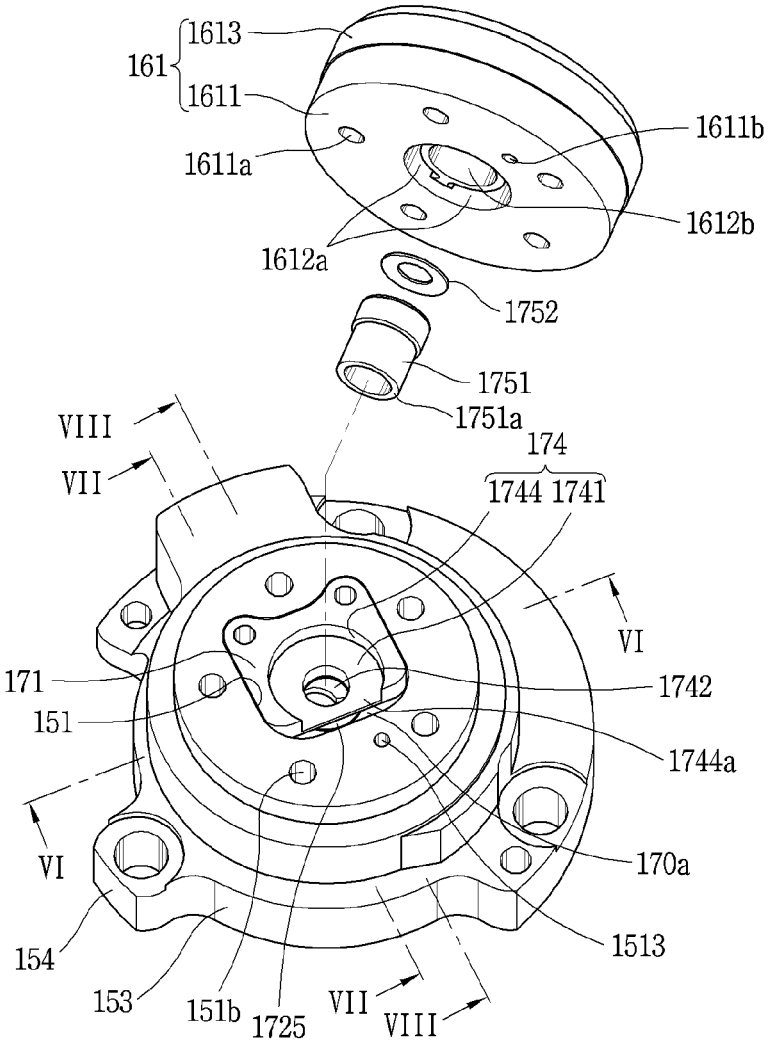
FIG. 5 is a perspective view of the valve assembly assembled with the non-orbiting scroll in FIG. 3.
Figure 6:
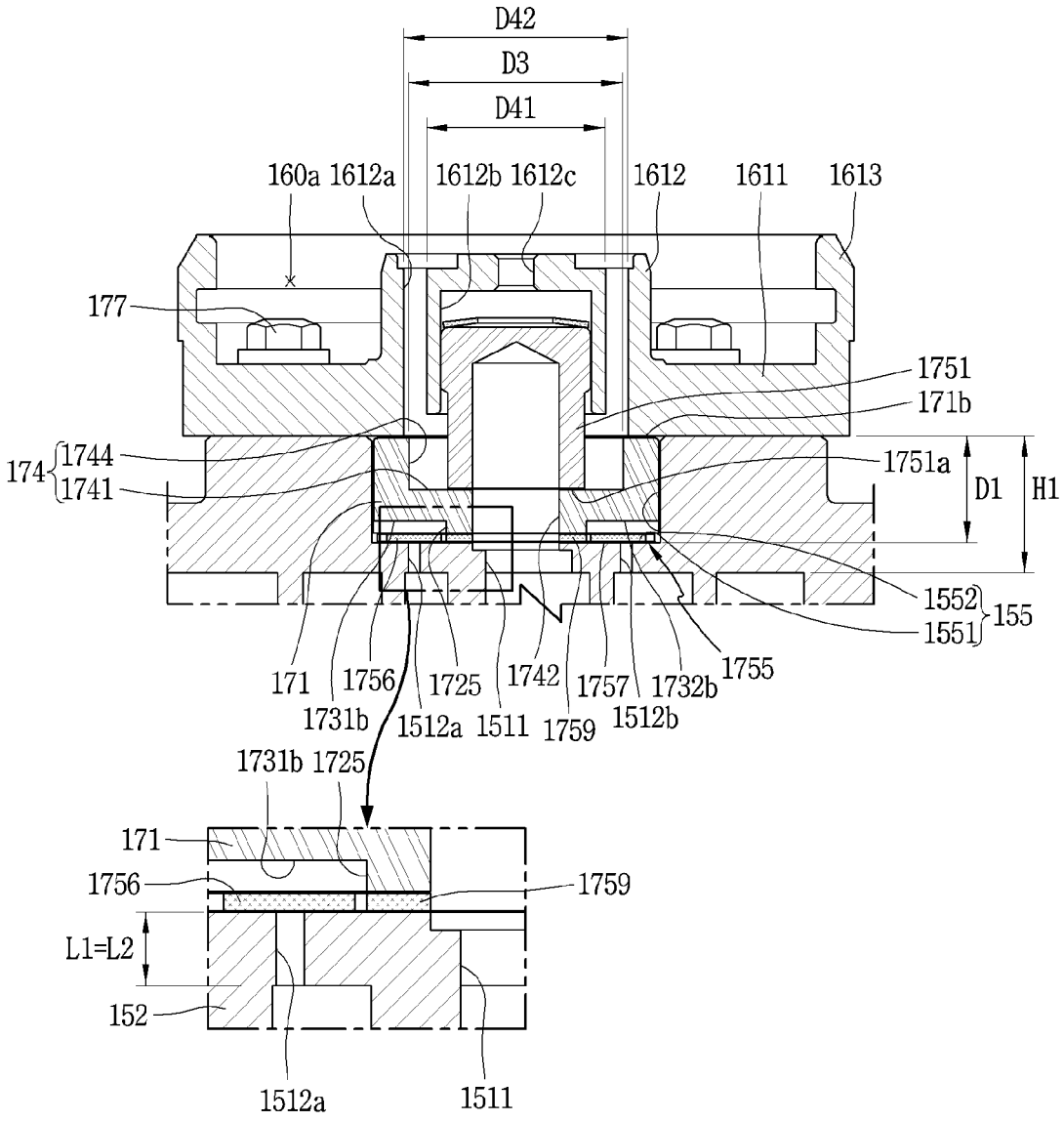
FIG. 6 is a cross-sectional view, taken along line "VI-VI" of FIG. 5.
Figure 7:
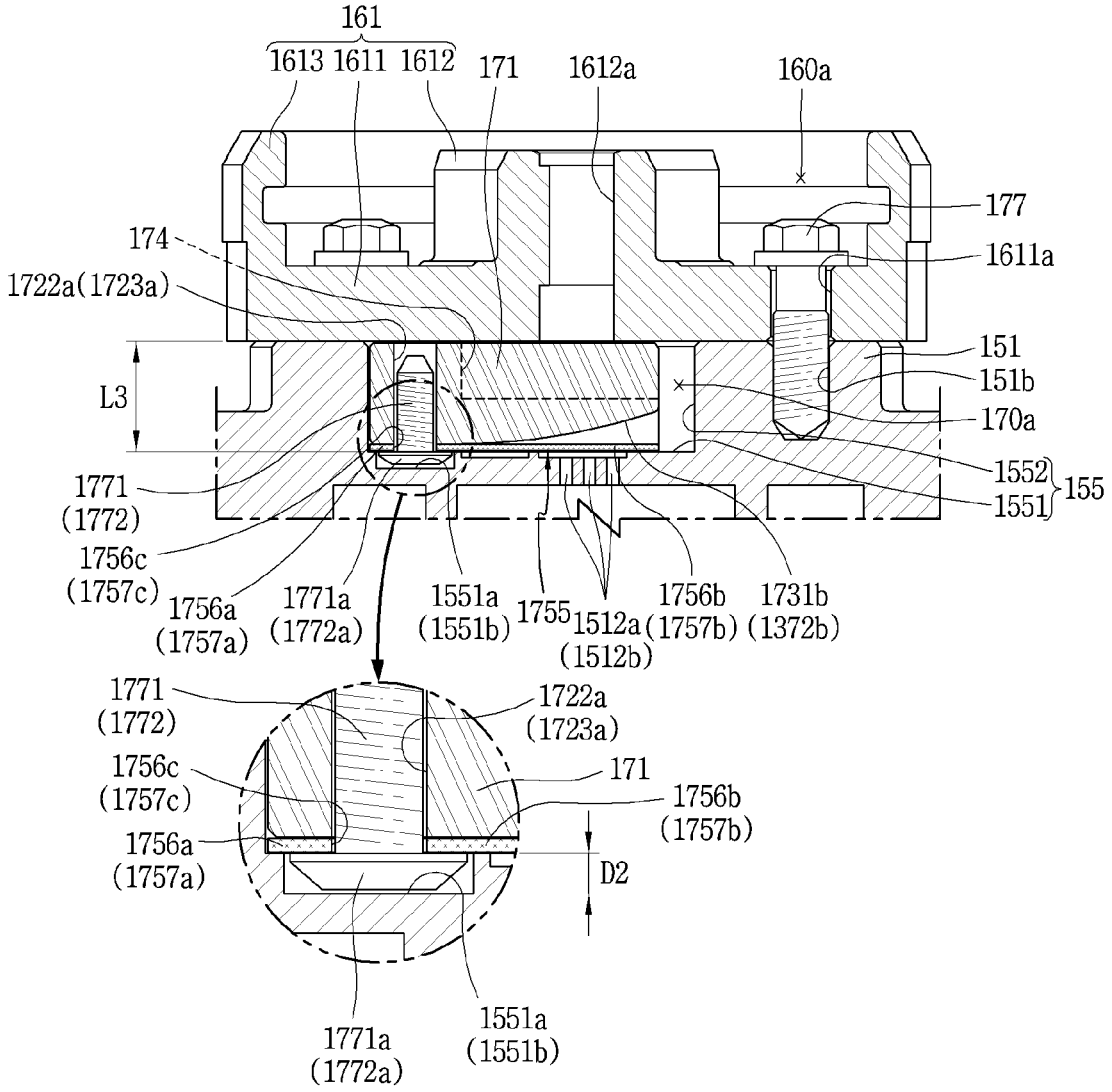
FIG. 7 is a cross-sectional view, taken along line "VII-VII" of FIG. 5.
Figure 8:
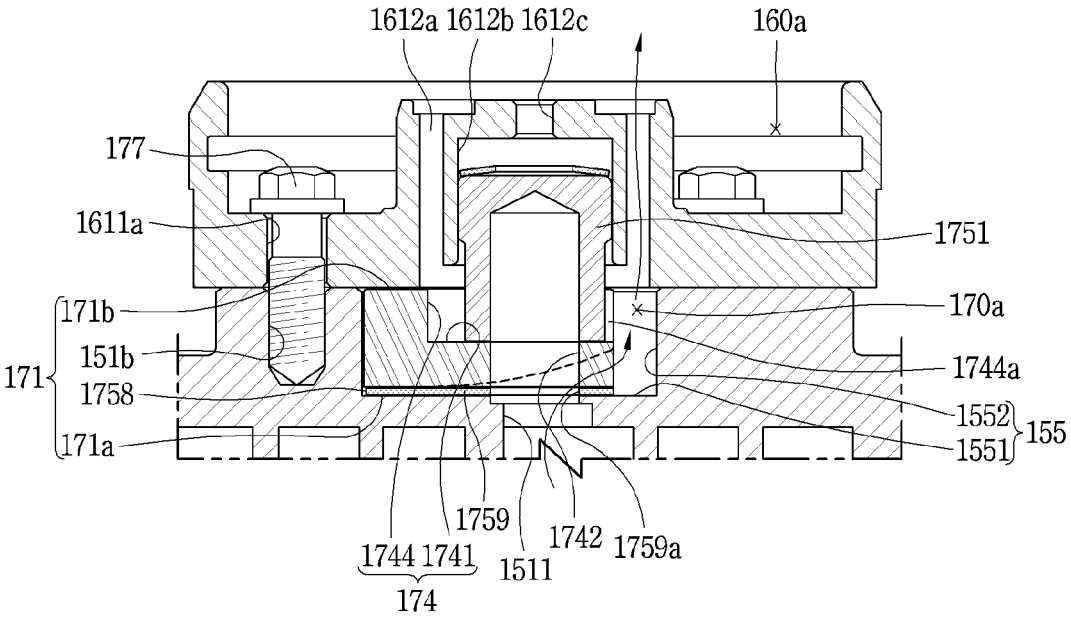
FIG. 8 is a cross-sectional view taken, along line "VIII-VIII" of FIG. 5.
Figure 9:
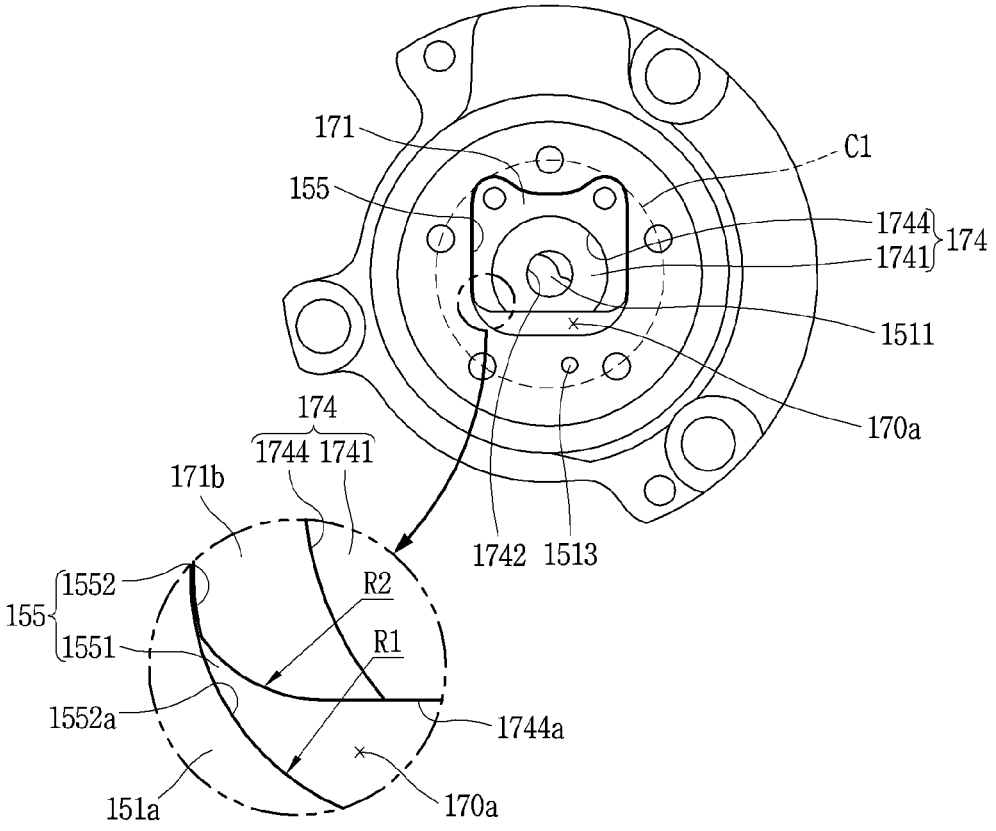
FIG. 9 is a planar view illustrating a state in which the valve assembly is assembled with the non-orbiting scroll in FIG. 5.
Figure 10:
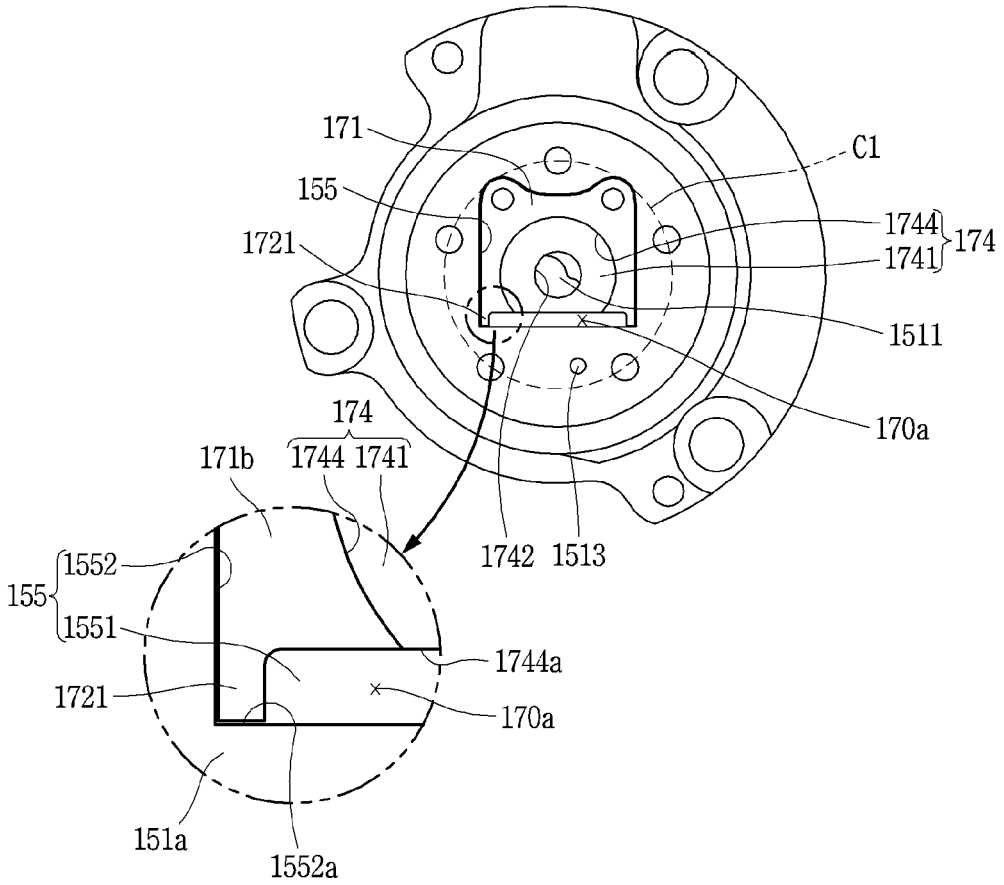
FIG. 10 is a planar view illustrating of an assembled state between the non-orbiting scroll and the valve assembly in FIG. 5 according to another embodiment.

FIG. 3 is an exploded perspective view of a valve assembly from a non-orbiting scroll in FIG. 2. FIG. 4 is an exploded perspective view of the valve assembly of FIG. 3 from a first axial side surface. FIG. 5 is a perspective view of the valve assembly assembled with the non-orbiting scroll in FIG. 3. FIG. 6 is a cross-sectional view, taken along line "VI-VI" of FIG. 5. FIG. 7 is a cross-sectional view, taken along line "VII-VII" of FIG. 5. FIG. 8 is a cross-sectional view, taken along line "VIII-VIII" of FIG. 5. FIG. 9 is a planar view illustrating a state in which the valve assembly is assembled with the non-orbiting scroll in FIG. 5, and FIG. 10 is a planar view illustrating an assembled state between the non-orbiting scroll and the valve assembly in FIG. 5 according to another embodiment.

Referring to FIGS. 3 to 8, the block insertion groove 155 may be recessed by a preset or predetermined depth into the rear surface 151*a* of the non-orbiting end plate 151. Accordingly, the block insertion groove 155 may be configured by a block seating surface 1551 defining a bottom surface, and a block accommodating surface 1552 that surrounds the block seating surface 1551.

The block seating surface 1551 may be flat, and the discharge port 1511 and bypass holes 1512*a* and 1512*b* described above may be respectively formed through the block seating surface 1551. In other words, the discharge port 1511 and the bypass holes 1512*a* and 1512*b* may be formed through the block seating surface 1551 in the axial direction. Accordingly, the discharge port 1511 and the bypass holes 1512*a* and 1512*b* may be located inside of the block insertion groove 155.

When the discharge port 1511 and the bypass holes 1512*a* and 1512*b* are formed inside of the block insertion groove 155 as in this embodiment, a length L1 of the discharge port 1511 and a length of each bypass hole 1512*a* and 1512*b* are shortened. Accordingly, depending on the type of the discharge valve 1751 and/or the bypass valve 1755, a dead volume in the discharge port 1511 and/or the bypass holes 1512*a* and 1512*b* may be reduced. For example, in the case where the bypass valve 1755 is a reed valve that is open and closed by being detached from and attached to upper surfaces of the bypass holes 1512*a* and 1512*b*, the bypass holes 1512*a* and 1512*b* are shortened, and thus, have reduced volumes, thereby decreasing the dead volumes. This is equally expected even in the case where the bypass valve 1755 is configured as a piston valve.

The block seating surface 1551 may include fastening member accommodating grooves 1551*a* in which heads 1771*a* and 1772*a* of fastening members 1771 and 1772 for fastening the bypass valve 1755 to the retainer block 171 may be accommodated. For example, the block seating surface 1551 may include first fastening member accommodating groove 1551*a* into which the head 1771*a* of the first fastening member 1771 may be inserted and second fastening member accommodating groove 1551*b* into which the head 1772*a* of the second fastening member 1772 may be inserted. The first and second fastening member accommodating grooves 1551*a* and 1551*b* may be recessed by a depth deeper or equal to a height of the heads 1771*a* and 1772*a*. Accordingly, the heads 1771*a* and 1772*a* of the fastening members 1771 and 1772 may be hidden even without using a separate gasket. With this configuration, the first axial side surface 171*a*, which is a lower surface of the retainer block 171, may be firmly supported by being in close contact with the block seating surface 1551, which is a bottom surface of the block insertion groove 155.

Referring to FIGS. 6 and 7, the first fastening member accommodating groove 1551*a* and the second fastening member accommodating groove 1551*b* may be formed relatively shallow because the head 1771*a* of the first fastening member 1771 and the head 1772*a* of the second fastening member 1772 are inserted therein. In other words, each depth D2 of the first fastening member accommodating groove 1551*a* and the second fastening member accommodating groove 1551*b* may be much shorter than each length L3 of first valve fastening hole 1722*a* and second valve fastening hole 1723*a*, which will be described hereinafter. Accordingly, a thickness of the non-orbiting end plate 151 required for fastening the bypass valve may be reduced, so that the non-orbiting end plate 151 may be formed thin. Through this, the length L1 of the discharge port 1511 and/or the length L2 of the bypass holes 1512*a* and 1512*b* may be shortened, thereby reducing the dead volume in the discharge port 1511 and/or the bypass holes 1512*a* and 1512*b*.

Although not illustrated, the first fastening member accommodating groove and/or the second fastening member accommodating groove may alternatively be formed to be recessed into first axial side surface 171*a* of the retainer block 171 facing the block seating surface 1551 of the block insertion groove 155, that is, into inlets of valve fastening holes 1722*a* and 1723*a*. In this case, peripheries of valve through-holes 1756*c* and 1757*c* of the bypass valve 1755 may be concave to correspond to the fastening member accommodating grooves. When the first fastening member accommodating groove and/or the second fastening member accommodating groove are formed in the first axial side surface 171*a* of the retainer block 171, the non-orbiting end plate 151 may be formed much thinner than that in the previous embodiment. This may further reduce the length of the discharge port 1511 and/or the lengths of the bypass holes 1512*a* and 1512*b* than those in the embodiment of FIG. 6, thereby further decreasing the dead volume.

Although not illustrated, the first fastening member accommodating groove and/or the second fastening member accommodating groove may alternatively be formed to partially correspond to the block seating surface 1551 of the block insertion groove 155 and the first axial side surface 171*a* of the retainer block 171 facing the block seating surface 1551, respectively. Even in this case, the thickness of the non-orbiting end plate 151 may be made thinner, and thus, the length of the discharge port 1511 and/or the lengths of the bypass holes 1512*a* and 1512*b* may be further reduced than those in the embodiment of FIG. 6. This may further decrease the dead volume.

Referring to FIG. 6, the block accommodating surface 1552 may be formed at a position that does not overlap the back pressure fastening grooves 151*b*. In other words, the plurality of back pressure fastening grooves 151*b* for fastening the back pressure plate 161 to the rear surface 151*a* of the non-orbiting end plate 151 may be formed in a manner such that the block accommodating surface 1552 defining the edge of the block insertion groove 155 is located within a first virtual circle (see FIG. 9) C1 connecting centers of the back pressure coupling grooves 151*b* in the circumferential direction. Accordingly, the back pressure fastening grooves 151*b* may be located outside of the block insertion groove 155, and thus, may be formed deeply even if the thickness H1 of the non-orbiting end plate 151 in the block insertion groove 155 becomes thin. This may secure fastening strength of the fastening bolts 177.

However, a portion of the block insertion groove 155, for example, valve fastening protrusions 1722 and 1723 for fastening the bypass valve 1755 described hereinafter may be formed outside of the first virtual circle C1 to be located between the adjacent back pressure fastening grooves 151*b* in the circumferential direction. Accordingly, the bypass valve 1755 may increase in length so as to obtain an enhanced response.

Referring to FIGS. 5 to 8, the block accommodating surface 1552 constituting an inner circumferential surface of the block insertion groove 155 may be formed in size and shape similar to those of an outer circumferential surface of the retainer block 171 described hereinafter. Accordingly, the retainer block 171 may be inserted into the block insertion groove 155 to be in close contact with the block accommodating surface 1552. This may allow the retainer block 171 to be stably fixed even if vibration of the compressor occurs.

For example, the block accommodating surface 1552 may have a substantially rectangular cross-sectional shape when projected in the axial direction, similar to the outer circumferential surface of the retainer block 171. Accordingly, four side surfaces constituting the block accommodating surface 1552 almost come into surface contact with four side surfaces constituting the outer circumferential surface of the retainer block 171. Therefore, the retainer block 171 may be stably fixed in the block insertion groove 155 even if a separate coupling member is not used.

However, a cross-sectional area of the block insertion groove 155 is wider than a cross-sectional area of the retainer block 171. In other words, three side surfaces of the block accommodating surface 1552 are formed to almost contact the outer circumferential surface (lateral surface) of the retainer block 171, but one side surface of the block accommodating surface 1552 is spaced apart from the outer circumferential surface of the retainer block 171. This may result in defining a discharge guide passage 170*a* between the inner circumferential surface of the block insertion groove 155 and the outer circumferential surface of the retainer block 171.

In addition, referring to FIGS. 5 and 9, the block accommodating surface 1552 may be formed in a rectangular cross-sectional shape, but corners may be curved. Accordingly, an area of the block insertion groove 155 may be as wide as possible without interfering with the back pressure fastening groove 151*b*.

A first block support surface 1552*a* may be formed on a portion of the block accommodating surface 1552. For example, among the four side surfaces of the block accommodating surface 1552, the first block support surface 1552*a* may be formed on one side surface (one side surface in a first lateral direction) in which the discharge guide passage 170*a* is defined such that an outer circumferential surface of the retainer block 171 is spaced apart from the inner circumferential surface of the block insertion groove 155. Accordingly, the discharge guide passage 170*a* may be defined with a preset or predetermined gap between the outer circumferential surface of the retainer block 171 (the side surface in the first lateral direction) and the inner circumferential surface of the block insertion groove 155 facing the retainer block 171, such that a bypass valve support part or portion (bypass valve support) 173 described hereinafter may communicate with a discharge valve accommodating part or portion 174. In the following description, a lateral direction of radially connecting the lateral surface where the discharge guide passage 170*a* is formed to an opposite lateral surface is defined as a first lateral direction, and another lateral direction orthogonal to the first lateral direction is defined as a second lateral direction.

The first block support surface 1552*a* may be stepped or curved. This embodiment illustrates an example in which the first block support surface 1552*a* is curved on corners of the inner circumferential surface of the block insertion groove 155. Accordingly, the corners of the retainer block 171 may be caught on the corners of the block insertion groove 155, that is, the first block support surface 1552*a*, to be restricted from moving in the first lateral direction, and the discharge guide passage 170*a* may be defined between the block insertion groove 155 and the retainer block 171.

A radius of curvature R1 of the first block support surface 1552*a* may be larger than a radius of curvature R2 of the retainer block 171. For example, when the corner of the retainer block 171 described hereinafter is curved, the radius of curvature R1 of the first block support surface 1552*a* may be larger than the radius of curvature R2 at the corner of the retainer block 171. Accordingly, the corner of the retainer block 171 may be supported in the lateral direction by the first block support surface 1552*a*.

A second block support surface 1552*b* may be formed on another side surface of the block accommodating surface 1552, that is, on a side surface (hereinafter, referred to as a "second lateral surface") opposite to the discharge guide passage 170*a*. For example, a first fastening protrusion insertion groove 1553*a* and a second fastening protrusion insertion groove 1553*b* into which the first valve fastening protrusion 1722 and the second valve fastening protrusion 1723 are inserted, respectively, may be formed in both ends of the second lateral surface of the block accommodating surface 1552, and the second block support surface 1552*b* which is inserted into a block support groove 1724 described hereinafter may convexly extend in a lateral direction toward the retainer block 171 between the both fastening protrusion insertion grooves 1553*a* and 1553*b*. Accordingly, the retainer block 171 may be stably supported in the block insertion groove 155 even in the second lateral direction.

Referring to FIGS. 3 to 8, the valve assembly 170 according to the embodiment may include retainer block 171 and valve member 175. The retainer block 171 may be fixedly inserted into the block insertion groove 155 formed in the non-orbiting end plate 151, and the valve member 175 may be fastened to the retainer block 171 to be located between the non-orbiting end plate 151 and the retainer block 171. Accordingly, the retainer block 171 and the valve member 175 may be modularized into the valve assembly 170, which may simplify assembly of the valve member 175, that is, the bypass valve.

In addition, the retainer block 171 may be fixed in a pressing manner between the non-orbiting scroll 150 and the back pressure chamber assembly 160, or may be fastened to or integrally formed with the back pressure chamber assembly 160. In this embodiment, an example in which the retainer block 171 is fixedly pressed between the non-orbiting scroll 150 and the orbiting scroll 160 will be described. Another example in which the retainer block 171 is fastened to or integrally formed with the back pressure chamber assembly 160 will be described hereinafter as another embodiment.

Referring to FIGS. 3 and 4, the retainer block 171 according to an embodiment may include a block body 172, a bypass valve support part or portion (bypass valve support) 173, and a discharge valve accommodating part or portion 174. The bypass valve support 173 may be formed on the first axial side surface 171*a* of the retainer block 171 where the block body 172 faces the non-orbiting scroll 150, and the discharge valve accommodating portion 174 is formed on a second axial side surface 171*b* of the retainer block 171 where the block body 172 faces the back pressure assembly 160.

The block body 172 may be formed in approximately the same shape as that of the block insertion groove 155 when projected in the axial direction so as to be inserted into the block insertion groove 155, but is slightly smaller than the block insertion groove 155. Accordingly, the block body 172 may be spaced apart from the block insertion groove 155, such that the discharge guide passage 170*a* is defined between the inner circumferential surface of the block insertion groove 155 and the outer circumferential surface of the block body 172. With this configuration, even if the block body 172 is located between the bypass hole 1512*a*, 1512*b* (and the discharge port) and an intermediate discharge port 1612*a*, refrigerant that has passed through the bypass hole 1512*a*, 1512*b* (and the discharge port) may smoothly flow to the intermediate discharge port 1612*a* through the discharge guide passage 170*a*.

For example, the discharge guide passage 170*a* may be defined by the first block support surface 1552*a* disposed on the inner circumferential surface of the block insertion groove 155, as described above. In other words, as the outer circumferential surface of the block body 172 is constrained in the first lateral direction by the first block support surface 1552*a* of the block insertion groove 155, one side surface of the block body 172 may be spaced apart from the inner circumferential surface of the block insertion groove 155.

However, as illustrated in FIG. 10, a block spacing protrusion 1721 may also be formed on the block body 172 to define the discharge guide passage 170*a*. For example, the block spacing protrusion 1721 may extend from a side surface of the block body 172 toward the inner circumferential surface of the block insertion groove 155 in the first lateral direction. An end portion of the block spacing protrusion 1721 may be in close contact with the inner circumferential surface of the block insertion groove 155. Accordingly, the discharge guide passage 170*a* may be defined in the first lateral surface of the block body 172 while being spaced apart from the inner circumferential surface of the block insertion groove 155 by a length of the block spacing protrusion 1721, so as to be located between the block body 172 and the block insertion groove 155.

The block spacing protrusion 1721 may be formed at each of both sides of the block body 172. In this case, the discharge guide passage 170*a* may be defined in an empty space between the block spacing protrusions 1721 and 1721. Accordingly, the block body 172 may be stably supported with respect to the first lateral direction as it is supported on both sides.

In addition, when the block spacing protrusion 1721 is formed on the block body 172, unlike the previous embodiment of FIG. 9, a corner of the block insertion groove 155 in the first lateral direction may be formed in a shape with a right angle or a substantially right angle. This may simplify the shape of the block insertion groove 155 to reduce manufacturing costs and may increase a volume of the discharge guide passage 170*a* such that refrigerant bypassed through the bypass hole 1512*a*, 1512*b* may quickly move to the intermediate discharge port 1612*a*. This is equally expected even in a case in which the block spacing protrusion (no reference numeral given) is formed on the inner circumferential surface of the block insertion groove 155 facing the block body 172.

Although not illustrated, only one block spacing protrusion 1721 may alternatively be formed on a side surface of the block body 172 (or the block insertion groove). In this case, empty spaces on both sides of the block spacing protrusion 1721 define the discharge guide passage 170*a*. In this case, a cross-sectional area of the block spacing protrusion 1721 may be reduced, which may result in enlarging an area of the discharge guide passage 170*a*.

Although not illustrated, the block spacing protrusion (not illustrated) may be formed on the inner circumferential surface of the block insertion groove 155 or may be formed to correspond to each of the block body 172 and the block insertion groove 155. Even in this case, the block spacing protrusion (not illustrated) may be formed in the same manner as in the previous embodiments.

Referring to FIGS. 4 and 7, the first valve fastening protrusion 1722 and the second valve fastening protrusion 1723 may be formed on another side surface of the block body 172 in the lateral direction, that is, another side surface in the first lateral direction, namely, a lateral surface located opposite to the first lateral surface where the discharge guide passage 170*a* is defined. The first valve fastening protrusion 1722 and the second valve fastening protrusion 1723 extend in the lateral direction from both sides of the another side surface of the block body 172 to protrude toward the inner circumferential surface of the block insertion groove 155, respectively. Accordingly, a block support groove 1724 into which the second block support surface 1552*b* of the block insertion groove 155 is inserted may be formed in a recessed manner between the valve fastening protrusions 1722 and 1723.

The first valve fastening hole 1722*a* is formed in the first valve fastening protrusion 1722 and the second valve fastening hole 1723*a* is formed in the second valve fastening protrusion 1723, respectively. The fastening members 1771 and 1772, for example, fastening bolts or fastening rivets, which are inserted through fixing portions 1756*a* and 1757*a* of the bypass valve 1755 described hereinafter, may be fixedly inserted into the first valve fastening hole 1722*a* and the second valve fastening hole 1723*a*, respectively. This embodiment illustrates an example in which the fastening rivets are applied. Accordingly, the fastening members 1771 and 1772 may be inserted into the first valve fastening hole 1722*a* and the second valve fastening hole 1723*a* from bottom to top, namely, from the non-orbiting scroll 150 to the back pressure assembly 160 while the heads 1771*a* and 1772*a* of the fastening members 1771 and 1772 support the bypass valve 1755 on the lower surface of the block body 172.

In this case, the head 1771*a* of the first fastening member 1771 and the head 1772*a* of the second fastening member 1772 are fully inserted into the first fastening member accommodating groove 1551*a* and the first fastening member accommodating groove 1551*a* of the block insertion groove 155, respectively. Accordingly, the heads 1771*a* and 1772*a* of the fastening members 1771 and 1772 may protrude downward from the block body 172, and also the block body 172 may be fixed in close contact with the bottom surface of the block insertion groove 155 by virtue of the heads 1771*a* and 1772*a* of the fastening members 1771 and 1772. In addition, the non-orbiting end plate 151 may be formed thin, thereby decreasing the dead volume in the discharge port 1511 and/or the bypass holes 1512*a* and 1512*b*.

Although not illustrated, the first fastening member accommodating groove 1551*a* and the second fastening member accommodating groove 1551*b* may be connected to each other. This may enhance the degree of freedom of fastening positions of the fastening members 1771 and 1772.

A discharge guide protrusion 1725 may be formed on the lower surface of the block body 172, that is, on the first axial side surface 171*a* of the retainer block 171. The discharge guide protrusion 1725 may extend from a center of the lower surface of the block body 172 toward the block seating surface 1551 of the block insertion groove 155 by a preset or predetermined height. Accordingly, a first valve support portion (first valve support) 1731 and a second valve support portion (second valve support) 1732 that constitute the bypass valve support 173 described hereinafter may be respectively formed on both sides of the discharge guide protrusion 1725 in the lateral direction.

A lower surface of the discharge guide protrusion 1725 may extend at the same height as the lower surface of the block body 172 (the first axial side surface of the retainer block). The lower surface of the discharge guide protrusion 1725 may define a second block fixing surface 1743 brought into close contact with the rear surface 151*a* of the non-orbiting end plate 151 to axially support the block body 172 at a side of the discharge guide passage 170*a*. Accordingly, the second block fixing surface 1743 may extend from a first block fixing surface 1733 described hereinafter at the same height to axially support the block body 172 at the side of the discharge guide passage 170*a*. Therefore, the block body 172 may be stably supported in the axial direction by the first block fixing surface 1733 described hereinafter and the second block fixing surface 1743.

The discharge guide protrusion 1725 may be formed in a hollow shape. In other words, a discharge guide hole 1742 described hereinafter may be formed axially through the discharge guide protrusion 1725. The discharge guide hole 1742 will be described hereinafter together with a discharge valve seating surface 1741 constituting discharge valve accommodating portion 174.

Referring to FIGS. 4 and 7, the bypass valve support 173 according to an embodiment may be formed on each of both sides of the block body 172 in the lateral direction. In other words, the bypass valve support 173 may extend in the first lateral direction from both sides of the second lateral direction, with respect to the discharge guide protrusion 1725. As the bypass valve support 173 is constituted by the first and second valve support portions 1731 and 1732 that are symmetrical with each other, a bypass valve support portion, that is, the first valve support portion 1731 of one side will be described representatively, and another bypass valve support portion, that is, the second valve support portion 1732 of another side will be understood by the description of the first valve support portion 1731.

For example, the first valve support portion 1731 may include first valve fixing surface 1731*a* and first valve opening/closing surface 1731*b*. The first valve fixing surface 1731*a* may be formed on the another side surface (the another side surface in the first lateral direction) of the block body 172 which is opposite to the discharge guide passage 170*a*, and the first valve opening/closing surface 1731*b* may be formed on the one side surface (the one side surface in the first lateral direction) of the block body 172 where the discharge guide passage 170*a* is located. Accordingly, the first valve support portion 1731 extends lengthwise in the first lateral direction of the block body 172.

The first valve fixing surface 1731*a* may be flat on one end of the block body 172 in the first lateral direction. Accordingly, the first valve fixing surface 1731*a* may be fixedly in close contact with the rear surface 151*a* of the non-orbiting end plate 151, together with the first fixing portion 1756*a* of the bypass valve 1755, which will be described hereinafter.

The first valve fixing surface 1731*a* may be connected to a second valve fixing surface 1732*a* of the adjacent second valve support portion 1732. In other words, the first valve fixing surface 1731*a* of the first valve support portion 1731 and the second valve fixing surface 1732*a* of the second valve support portion 1732 may be formed flat at the same height and connected to each other. Accordingly, a first block fixing surface 1733 that axially supports the another side surface of the block body 172, namely, the opposite side of the discharge guide passage 170*a* with respect to the block seating surface 1551 of the block insertion groove 155 may be formed between the first valve fixing surface 1731*a* and the second valve fixing surface 1732*a*. Through this, the first block fixing surface 1733 of the retainer block 171 may be widely supported by the block seating surface 1551 of the block insertion groove 155, and the retainer block 171 may be stably fixed in the axial direction.

The first valve opening/closing surface 1731*b* may be spaced apart from the block seating surface 1551 by a preset or predetermined gap. In other words, the first valve opening/closing surface 1731*b* may be curved or inclined from the first valve fixing surface 1731*a* toward the discharge guide passage 170*a*. Accordingly, when a first opening/closing portion 1756*b* of the bypass valve 1755, which will be described hereinafter, is open, the first opening/closing portion 1756*b* is sequentially brought into contact with the first valve opening/closing surface 1731*b* while rotating relative to the first fixing portion 1756*a*. This may prevent valve knocking noise from being generated due to the bypass valve 1755 hitting the first valve opening/closing surface 1731*b* when it is open and closed.

The first valve opening/closing surface 1731*b* may be spaced apart from the second valve opening/closing surface 1732*b* in the second lateral direction. In other words, the first valve opening/closing surface 1731*b* may be located at an opposite side of the second valve opening/closing surface 1732*b* with the discharge guide protrusion 1725 therebetween. Accordingly, the first valve opening/closing surface 1731*b* and the second valve opening/closing surface 1732*b* may be connected to each other by the discharge guide protrusion 1725.

A first discharge guide surface 1734*a* may be formed at an end portion of the first valve opening/closing surface 1731*b* where the discharge guide passage 170*a* is located, namely, formed between the first valve opening/closing surface 1731*b* and the outer circumferential surface of the discharge guide protrusion 1725. In other words, the first discharge guide surface 1734*a* may be formed at a portion of the outer circumferential surface of the discharge guide protrusion 1725 that meets the end portion of the first valve opening/closing surface 1731*b* where the discharge guide passage 170*a* is defined. The same structure is applied to the second discharge guide surface 1734*b* formed on the second valve opening/closing surface 1732*b*.

A cross-sectional area of the first discharge guide surface 1734*a* increases toward the discharge guide passage 170*a*. In other words, as the outer circumferential surface of the discharge guide protrusion 1725 is curved or inclined, the cross-sectional area of the first discharge guide surface 1734*a* becomes wider toward the discharge guide passage 170*a*. Accordingly, flow resistance between the bypass valve support portion 173 and the discharge valve accommodating portion 174 may be reduced, so that refrigerant discharged through the bypass holes 1512*a* and 1512*b* may quickly move toward the discharge guide passage 170*a* and the discharge valve accommodating portion 174.

The second valve support portion 1732 may include second valve fixing surface 1732*a* and second valve opening/closing surface 1732*b*. The second valve fixing surface 1732*a* corresponds to the first valve fixing surface 1731*a*, and the second valve opening/closing surface 1732*b* corresponds to the first valve opening/closing surface 1731*b*, respectively. Thus, description thereof corresponds to the description of the first valve fixing surface 1731*a* and the first valve opening/closing surface 1731*b*, and repetitive description has been omitted.

Referring to FIGS. 3 and 8, the discharge valve accommodating portion 174 according to this embodiment is formed in a substantially central region of the block body 172. Accordingly, the discharge valve 1751 may be accommodated in the discharge valve accommodating portion 174 to open and close the discharge port 1511 located in the center of the non-orbiting end plate 151.

The discharge valve accommodating portion 174 may be recessed by a preset or predetermined depth into one side surface of the block body 172, or may be formed through the block body 172. Accordingly, an opening/closing position of an opening/closing surface 1751*a* of the discharge valve 1751 may be determined depending on the shape of the discharge valve accommodating portion 174.

For example, when the discharge valve accommodating portion 174 is recessed, the opening/closing surface 1751*a* of the discharge valve 1751 becomes the bottom surface of the discharge valve accommodating portion 174. On the other hand, when the discharge valve accommodating portion 174 is formed through the block body 172, the opening/closing surface 1751*a* of the discharge valve 1751 becomes the rear surface 151*a* of the non-orbiting end plate 151. This embodiment illustrates an example in which the discharge valve accommodating portion 174 is recessed into one side surface of the block body 172 toward the rear surface 151*a* of the non-orbiting end plate 151 by a preset or predetermined depth.

More specifically, the discharge valve accommodating portion 174 according to this embodiment may include a discharge valve seating surface 1741 and a discharge valve accommodating surface 1744. The discharge valve seating surface 1741 defines a bottom surface of the discharge valve accommodating portion 174, and the discharge valve accommodating surface 1744 defines an inner surface of the discharge valve accommodating portion 174 by surrounding the discharge valve seating surface 1741. Accordingly, refrigerant discharged from the discharge port 1511 moves to the intermediate discharge port 1612*a* of the back pressure plate 161 via the discharge valve accommodating portion 174.

In addition, the discharge valve accommodating portion 174 may be recessed by a preset depth into one side surface of the block body 172, for example, into an upper surface (second axial side surface) 172*b* of the block body 172 that faces the back pressure chamber assembly 160. However, a discharge passage groove 1744*a* may be formed in the discharge valve accommodating surface 1744 constituting the discharge valve accommodating portion 174 to communicate with the discharge guide passage 170*a*. The discharge passage groove 1744*a* may be formed by opening one side surface of the discharge valve accommodating surface 1744 toward the discharge guide passage 170*a* in the lateral direction. Accordingly, refrigerant discharged through the bypass holes 1512*a* and 1512*b* may flow into the discharge valve accommodating portion 174 through the discharge guide passage 170*a* and the discharge passage groove 1744*a*. This refrigerant then moves toward the intermediate discharge port 1612*a* together with refrigerant discharged through the discharge port 1511.

The discharge valve seating surface 1741 may be wider than the opening/closing surface 1751*a* of the discharge valve 1751 so that the discharge valve 1751 is seated thereon. The discharge valve seating surface 1741 may be flat such that the discharge guide hole 1742 described hereinafter is open and closed as the opening/closing surface 1751*a* of the discharge valve 1751 is brought into contact with or separated from the discharge valve seating surface 1741. Accordingly, when the discharge valve 1751 is closed, the opening/closing surface 1751*a* of the discharge valve 1751 is seated on the discharge valve seating surface 1741 to tightly close the discharge guide hole 1742 described hereinafter.

The discharge guide hole 1742 may be formed axially through the discharge guide protrusion 1725 and the discharge valve accommodating portion 174. In other words, the discharge guide hole 1742 may be formed through a portion between the second block fixing surface 1743 defining the lower surface of the discharge guide protrusion 1725 and the discharge valve seating surface 1741 defining the bottom surface of the discharge valve accommodating portion 174. Accordingly, the discharge port 1511 may communicate with the discharge valve accommodating portion 174 through the discharge guide hole 1742.

The discharge guide hole 1742 may be formed on a same axial line as the discharge port 1511 or be formed to at least partially communicate with the discharge port 1511 even though it is formed on a different axial line from the discharge port 1511. In other words, an inner diameter of the discharge guide hole 1742 may be larger than or equal to an inner diameter of the discharge hole 1511 so that the discharge port 1511 is accommodated in the discharge guide hole 1742. Accordingly, refrigerant that has passed through the discharge port 1511 moves into the discharge valve accommodating portion 174 through the discharge guide hole 1742.

Referring to FIGS. 3 and 6, the discharge valve accommodating surface 1744 may be stepped at a preset or predetermined height from an edge of the discharge valve seating surface 1741 so as to surround the discharge valve seating surface 1741. Accordingly, the discharge valve accommodating surface 1744 determines an actual volume of the discharge valve accommodating portion 174.

The discharge valve accommodating surface 1744 may be formed in a circular shape or may be formed in a linear shape. This embodiment illustrates that the discharge valve accommodating surface 1744 has a combined form of circular and linear shapes and one side surface of the discharge valve accommodating surface 1744 is open toward the inner circumferential surface of the block insertion groove 155. Therefore, the discharge valve accommodating portion 174 may communicate with the discharge guide passage 170*a*, so that refrigerant passing through the bypass holes 1512*a* and 1512*b* may quickly move to the discharge valve accommodating portion 174 through the discharge guide passage 170*a*.

The discharge valve accommodating surface 1744 may be formed in a circular shape when projected in the axial direction. This may minimize an area of the discharge valve accommodating portion 174 and simultaneously allow the discharge valve accommodating portion 174 to communicate with the intermediate discharge port 1612*a* of the back pressure plate 161 without interference. For example, an inner diameter D3 of the discharge valve accommodating surface 1744 may be larger than or equal to an outer diameter D41 of a virtual circle connecting the inner circumferential surface of the intermediate discharge port 1612*a* and smaller than or equal to an inner diameter D42 of a virtual circle connecting an outer circumferential surface. Accordingly, when projected in the axial direction, the intermediate discharge port 1612*a* may be fully included in the discharge valve accommodating portion 174, such that refrigerant introduced into the discharge valve accommodating portion 174 may quickly move to the intermediate discharge port 1612*a* without clogging.

In addition, the discharge valve accommodating surface 1744 may be stepped from the discharge valve seating surface 1741 toward the back pressure plate 161. For example, the discharge valve accommodating surface 1744, as illustrated in FIG. 6, may be stepped at a right angle with respect to the discharge valve seating surface 1741. This may maximize a volume of the discharge valve accommodating portion 174, so that refrigerant discharged through the discharge port 1511 and/or the bypass holes 1512*a* and 1512*b* may smoothly flow into the discharge valve accommodating portion 174 and then may be discharged to the high-pressure portion 110*b* through the intermediate discharge port 1612*a*. This may also simplify the structure of the discharge valve accommodating surface 1744, thereby facilitating formation of the discharge valve accommodating portion 174.

Figure 11:
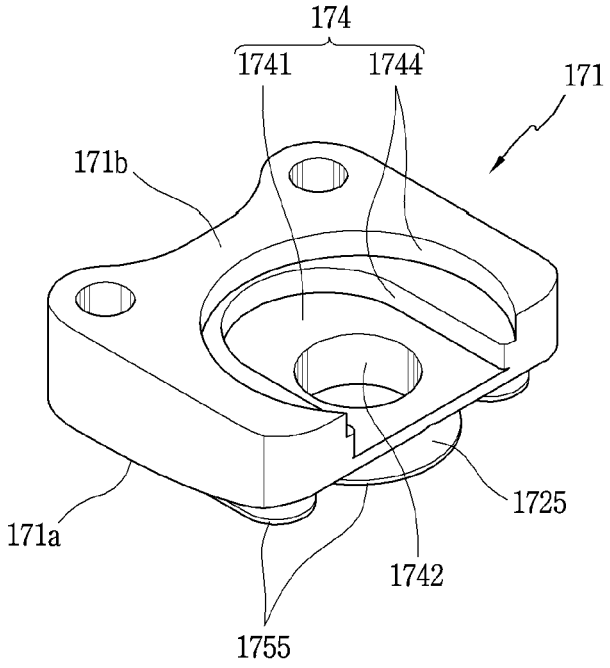
FIG. 11 is a perspective view of a retainer block in a valve assembly in accordance with another embodiment.
Figure 12:
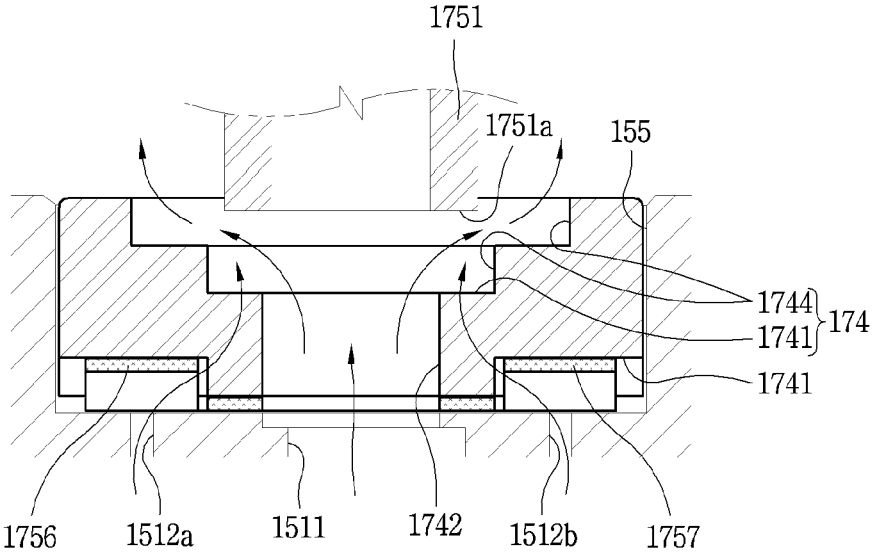
FIG. 12 is a cross-sectional view of the retainer block of FIG. 11.
Figure 13:
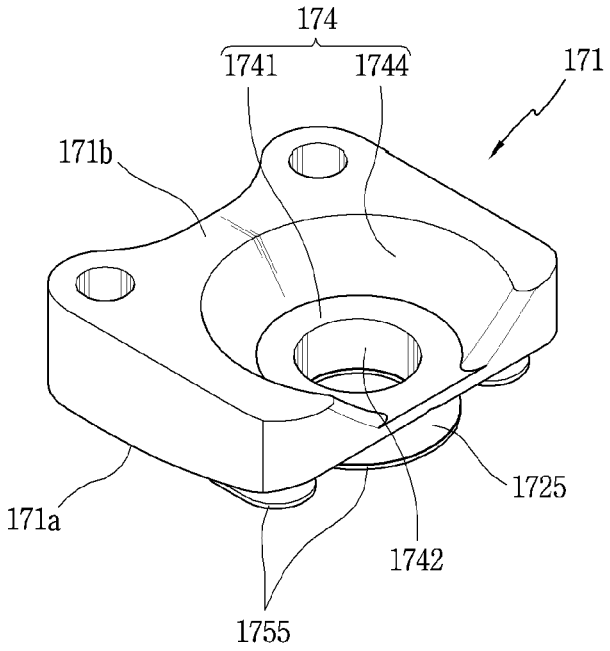
FIG. 13 is a perspective view of a retainer block in a valve assembly in accordance with still another embodiment.
Figure 14:
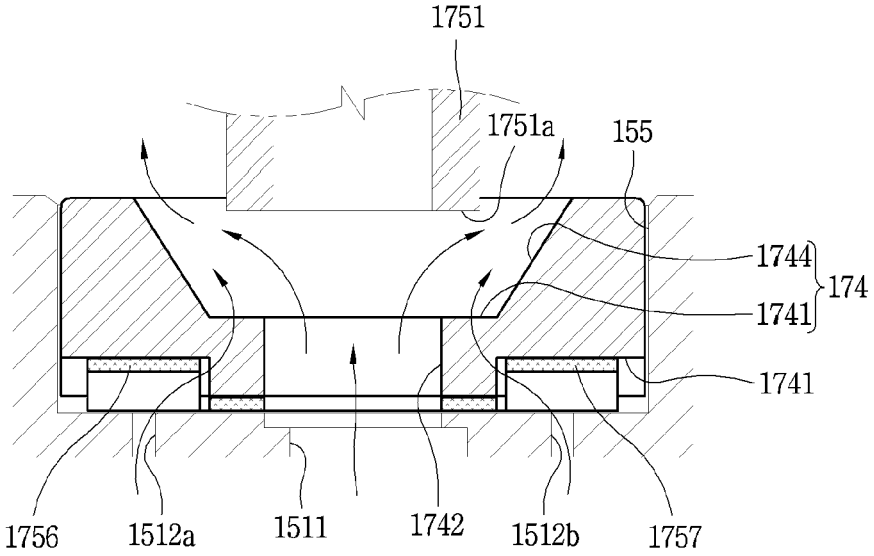
FIG. 14 is a cross-sectional view of the retainer block of FIG. 13.

However, depending on cases, the discharge valve accommodating surface 1744 may be formed to be multiply stepped or inclined. FIG. 11 is a perspective view of a retainer block in a valve assembly in accordance with another embodiment. FIG. 12 is a cross-sectional view of the retainer block of FIG. 11. FIG. 13 is a perspective view of a retainer block in a valve assembly in accordance with still another embodiment. FIG. 14 is a cross-sectional view of the retainer block of FIG. 13.

The discharge valve accommodating surface 1744 may be formed in two steps illustrated in FIGS. 11 and 12, or may be formed as an inclined surface as illustrated in FIGS. 13 and 14. In these cases, even if the discharge valve accommodating portion 174 is formed deep and the height of the discharge valve accommodating surface 1744 increases, stagnation of refrigerant near the discharge valve accommodating surface 1744 due to a vortex may be avoided. Through this configuration, the discharge valve accommodating portion 174 may be formed deep, which may result in reducing a thickness of the discharge valve accommodating portion 174, for example, the length of the discharge guide hole 1742 and allowing refrigerant to quickly move to the intermediate discharge port 1612*a* without stagnating in the discharge valve accommodating portion 174.

Referring back to FIGS. 2 to 5, the valve member 175 according to this embodiment may include the discharge valve 1751 and the bypass valve 1755. The discharge valve 1751 may be a piston valve and the bypass valve 1755 may be a reed valve. However, embodiments are not limited thereto. In other words, the discharge valve 1751 may be a reed valve and the bypass valve 1755 may be a piston valve. However, as described above, this embodiment will be described based on an example in which the discharge valve 1751 is a piston valve and the bypass valve 1755 is a reed valve.

The discharge valve 1751 may be slidably inserted in the axial direction into the valve guide groove 1612*b* provided in the back pressure plate 161 to open and close the discharge guide hole 1742 described above. The discharge valve 1751 is always or periodically accommodated in the discharge valve accommodating portion 174. For example, when the discharge valve 1751 is longer than a depth of the discharge valve accommodating portion 174, the opening/closing surface 1751*a* of the discharge valve 1751 may be located inside of the discharge valve accommodating portion 174 not only when the discharge valve 1751 is closed but also when the discharge valve 1751 is open. On the other hand, when the discharge valve 1751 is shorter than the depth of the discharge valve accommodating portion 174, the opening/closing surface 1751*a* of the discharge valve 1751 may be located outside of the discharge valve accommodating portion 174 when the discharge valve 1751 is open. In the former case, the discharge valve 1751 may be quickly closed, whereas in the latter case, discharge resistance due to the discharge valve 1751 may be reduced.

The discharge valve 1751 may be formed in a shape of a rod or cylinder. In other words, the discharge valve 1751 may be formed in a solid cylindrical shape or a hollow cylindrical shape. The discharge valve 1751 of this embodiment may be formed in a semi-circular rod or semi-cylindrical shape with an upper end closed and a lower end open. This may reduce a weight of the discharge valve 1751 and simultaneously prevent oil in the high-pressure portion 110*b*, which is a discharge space, from accumulating inside of the discharge valve 1751.

Although not illustrated, the discharge valve 1751 may alternatively be formed in a semi-circular rod or semi-cylindrical shape with an upper end open and a lower end closed. In this case, the weight of the discharge valve 1751 may be reduced, and the opening/closing surface of the discharge valve 1751 may be close to the discharge port 1511, thereby decreasing a dead volume. However, in this case, an oil discharge hole (not illustrated) may be formed near the opening/closing surface 1751*a* of the discharge valve 1751 to penetrate through between inner and outer circumferential surfaces of the discharge valve, thereby preventing stagnation of oil in the discharge valve 1751.

Referring back to FIGS. 3 to 8, the bypass valve 1755 may include first bypass valve part or portion (first bypass valve) 1756 and a second bypass valve part or portion (second bypass valve) 1757. In other words, the first bypass hole 1512*a* may be open and closed by the first bypass valve 1756, and the second bypass hole 1512*b* may be open and closed by the second bypass valve 1757, respectively.

The first bypass valve 1756 and the second bypass valve 1757 may be formed independently to be independently fastened to the retainer block 171, or the first bypass valve 1756 and the second bypass valve 1756 may be connected to each other so as to be fastened to the retainer block 171 at once. The embodiment illustrates an example in which the first bypass valve 1756 and the second bypass valve 1757 are connected to each other and fastened to the retainer block 171 at once.

In the case in which the first bypass valve 1756 and the second bypass valve 1757 are connected to each other as in this embodiment, assembly of the bypass valve 1755 may be facilitated. In addition, in this case, the bypass valve 1755 has a plurality of fixed ends, which may prevent an alignment position of the bypass valve 1755 from being distorted during fastening.

As the first bypass valve 1756 and the second bypass valve 1757 are formed as a single valve member in this embodiment, a combination of the first bypass valve 1756 and the second bypass valve 1757 will be described as the bypass valve 1755. That is, the bypass valve 1755 includes first bypass valve 1756, second bypass valve 1757, a valve connection part or portion 1758, and a sealing connection part or portion 1759. However, the sealing connection portion 1759 may be excluded in some cases. For example, when a valve fixing groove (not illustrated) is formed in the first block fixing surface 1733 of the block body 172 so that the first bypass valve 1756, the second bypass valve 1757, and the valve connection portion 1758 are inserted, the first block fixing surface 1733 becomes lower than the second blocking fixing surface 1743, so the sealing connection portion 1759 may be excluded. However, in this embodiment, as the first block fixing surface 1733 is formed on the same surface as the second block fixing surface 1743, an example in which the sealing connection portion 1759 is provided will be mainly described.

The first bypass valve 1756 may include a first fixing portion 1756*a* and a first opening/closing portion 1756*b*. The first fixing portion 1756*a* is a portion forming a fixed end of the first bypass valve 1756, and the first opening/closing portion 1756*b* is a portion forming a free end of the first fixing portion 1756*a*. Accordingly, the first bypass valve 1756 forms a cantilever.

In addition, as the first bypass valve 1756 is formed in a rectangular shape, the first fixing portion 1756*a* and the first opening/closing portion 1756*b* are connected by a first connection portion (no reference numeral given) which is long and narrow, but the first connection portion rotates relative to the first fixing portion 1756*a* together with the first opening/closing portion 1756*b*. Therefore, it will be understood hereinafter that the first connection portion is included in the first opening/closing portion 1756*b*. This is also applied to the second bypass valve 1757.

The first fixing portion 1756*a* is fixed in close contact between the retainer block 171 and the non-orbiting end plate 151. In other words, both side surfaces of the first fixing portion 1756*a* are fixed in close contact with the first valve fixing surface 1731*a* of the retainer block 171 and the block seating surface 1551 of the non-orbiting end plate 151, respectively. Accordingly, the retainer block 171 is fixed in close contact with the block insertion groove 155.

The first fixing portion 1756*a* may include a first valve through-hole 1756*c* through which the first fastening member (first rivet) 1771 may be inserted. An inner diameter of the first valve through-hole 1756*c* may be smaller than an outer diameter of the head 1771*a* of the first fastening member 1771. Accordingly, the first fixing portion 1756*a* may be firmly fixed to the first axial side surface 171*a*, which is the lower surface of the retainer block 171, by the head 1771*a* of the first fastening member 1771 which is inserted therethrough from the non-orbiting scroll 150 toward the retainer block 171.

The first opening/closing portion 1756*b* may extend from the first fixing portion 1756*a* to be bendable between the retainer block 171 and the non-orbiting end plate 151. In other words, one (first) end of the first opening/closing portion 1756*b* extends from the first fixing portion 1756*a* and the other (second) end is formed as a free end to form a cantilever. Accordingly, the first opening/closing portion 1756*b* may be flexibly bent based on the first fixing portion 1756*a* in a space defined between the first valve opening/closing surface 1731*b* of the retainer block 171 and the block seating surface 1551 of the non-orbiting end plate 151 facing the first valve opening/closing surface 1731*b*.

A cross-sectional area of the first opening/closing portion 1756*b* may be wider than that of the first bypass hole 1512*a*. Accordingly, the first opening/closing portion 1756*b* opens and closes the first bypass hole 1512*a* while being flexibly bent based on the first fixing portion 1756*a* by pressure of the compression chamber V.

The second bypass valve 1757 may include a second fixing portion 1757*a* and a second opening/closing portion 1757*b*. The second fixing portion 1757*a* is a portion forming a fixed end of the second bypass valve 1757 and corresponds to the first fixing portion 1756*a*, and the second opening/closing portion 1757*b* is a portion forming a free end of the second fixing portion 1757*a* and corresponds to the first opening/closing portion 1756*b*. Therefore, description of the second bypass valve 1757 may be understood as similar to or the same as the description of the first bypass valve 1756, and repetitive discussion has been omitted.

However, the second fixing portion 1757*a* may include a second valve through-hole 1757*c*, and a cross-sectional area of the second opening/closing portion 1757*b* is wider than that of the second bypass hole 1512*b*. Accordingly, the first fixing portion 1756*a* may be fixed to the second valve fixing surface 1732*a* of the retainer block 171 by the head 1772*a* of the second fastening member 1772, and the second opening/closing portion 1757*b* opens and closes the second bypass hole 1512*b* by being bent based on the second fixing portion 1757*a*.

The valve connection portion 1758 is a portion that connects the first bypass valve 1756 and the second bypass valve 1757, more specifically, the first fixing portion 1756*a* and the second fixing portion 1757*a*. The valve connection portion 1758 may integrally extend from the first bypass valve 1756 and the second bypass valve 1757. Accordingly, the bypass valve 1755 may be easily assembled, and each of the fastening members 1771 and 1772 may be provided as one in number for the fastening of the first bypass valve 1756 and the second bypass valve 1757, whereby the same effect may be achieved as that achieved on the use of the fastening members 1771 and 1772 by two each. Through this, when the bypass valve 1755 is fastened, misalignment due to distortion of the bypass valve 1755 may be suppressed or prevented.

In addition, the valve connection portion 1758 may be formed flat to have the same thickness as the first bypass valve 1756 and the second bypass valve 1757. Accordingly, the bypass valve 1755 may be tightly fixed between the first block fixing surface 1733 of the retainer block 171 and the block seating surface 1551 of the non-orbiting end plate 151.

The sealing connection portion 1759 is a portion disposed for reinforcement between the lower surface of the discharge guide protrusion 1725, that is, the second block fixing surface 1743 and the block seating surface 1551 facing the second block fixing surface 1743. The sealing connection portion 1759 may be formed in a same cross-sectional shape as the second block fixing surface 1743, which is the lower surface of the discharge guide protrusion 1725 (the first axial side surface of the retainer block). Accordingly, a discharge communication hole 1759*a* is formed through the sealing connection portion 1759 to communicate with the discharge guide hole 1742.

An inner diameter of the discharge communication hole 1759*a* is equal to or larger than that of the discharge guide hole 1742. Accordingly, the sealing connection portion 1759 does not interfere with the discharge guide hole 1742, so that refrigerant passing through the discharge guide hole 1742 may smoothly move toward the discharge valve accommodating portion 174 without being blocked by the sealing connection portion 1759.

In the drawings, unexplained reference numeral 1554 denotes a valve buffer groove that suppresses or prevents opening and closing resistance of the bypass valve, and 1752 denotes an elastic member that supports the discharge valve.

The scroll compressor according to embodiments disclosed herein may operate as follows.

That is, when power is applied to the drive motor 120 and a rotational force is generated, the orbiting scroll 140 eccentrically coupled to the rotary shaft 125 performs an orbiting motion relative to the non-orbiting scroll 150 due to the Oldham ring 180. At this time, the first compression chamber V1 and the second compression chamber V2 that continuously move are formed between the orbiting scroll 140 and the non-orbiting scroll 140. Then, the first compression chamber V1 and the second compression chamber V2 are gradually reduced in volume as moving from the suction port (or suction chamber) 1531 to the discharge port (or discharge chamber) 1511 during the orbiting motion of the orbiting scroll 140.

At this time, refrigerant is suctioned into the low-pressure portion 110*a* of the casing 110 through the refrigerant suction pipe 117. Some of this refrigerant is suctioned directly into the suction pressure chambers (no reference numerals given) of the first compression chamber V1 and the second compression chamber V2, respectively, while the remaining refrigerant first flows toward the drive motor 120 to cool down the drive motor 120 and then is suctioned into the suction pressure chambers (no reference numerals given).

The refrigerant is compressed while moving along moving paths of the first compression chamber V1 and the second compression chamber V2. The compressed refrigerant partially flows into the back pressure chamber 160*a* formed by the back pressure plate 161 and the floating plate 165 through the first back pressure hole 1513 and the second back pressure hole 1611*b* before reaching the discharge port 1511. Accordingly, the back pressure chamber 160*a* forms an intermediate pressure.

Then, the floating plate 165 may rise toward the high/low pressure separation plate 115 to be brought into close contact with the sealing plate 1151 provided on the high/low pressure separation plate 115. Then, the high-pressure portion 110*b* of the casing 110 may be separated from the low-pressure portion 110*a*, to prevent the refrigerant discharged from each compression chamber V1 and V2 from flowing back into the low-pressure portion 110*a*.

On the other hand, the back pressure plate 161 is pressed down toward the non-orbiting scroll 150 by pressure of the back pressure chamber 160*a*. Then, the non-orbiting scroll 150 is pressed toward the orbiting scroll 140. Accordingly, the non-orbiting scroll 150 may be brought into close contact with the orbiting scroll 140, thereby preventing the refrigerant inside of both compression chambers from leaking from a high-pressure compression chamber forming an intermediate pressure chamber to a low-pressure compression chamber.

The refrigerant is compressed to a set or predetermined pressure while moving from the intermediate pressure chamber toward the discharge pressure chamber. This refrigerant moves to the discharge port 1511 and the discharge guide hole 1742 communicating with the discharge port 1511 to press the discharge valve 1751 in an opening direction. Responsive to this, the discharge valve 1751 is pushed up along the valve guide groove 1612*b* by pressure of the discharge pressure chamber, so as to open the discharge port 1511 and the discharge guide hole 1742. Then, the refrigerant in the discharge pressure chamber exhausts to the discharge valve accommodating portion 174 through the discharge port 1511 and the discharge guide hole 1742, and then flows toward the high-pressure portion 110*b* through the intermediate discharge port 1612*a* provided in the back pressure plate 161 (See FIG. 15).

The pressure of the refrigerant may rise above a preset or predetermined pressure due to various conditions occurring during operation of the compressor. Then, the refrigerant moving from the intermediate pressure chamber to the discharge pressure chamber may be partially bypassed in advance from the intermediate pressure chamber forming each compression chamber V1 and V2 toward the high-pressure portion 110*b* through the first bypass hole 1512*a* and the second bypass hole 1512*b* before reaching the discharge pressure chamber.

Figure 15:
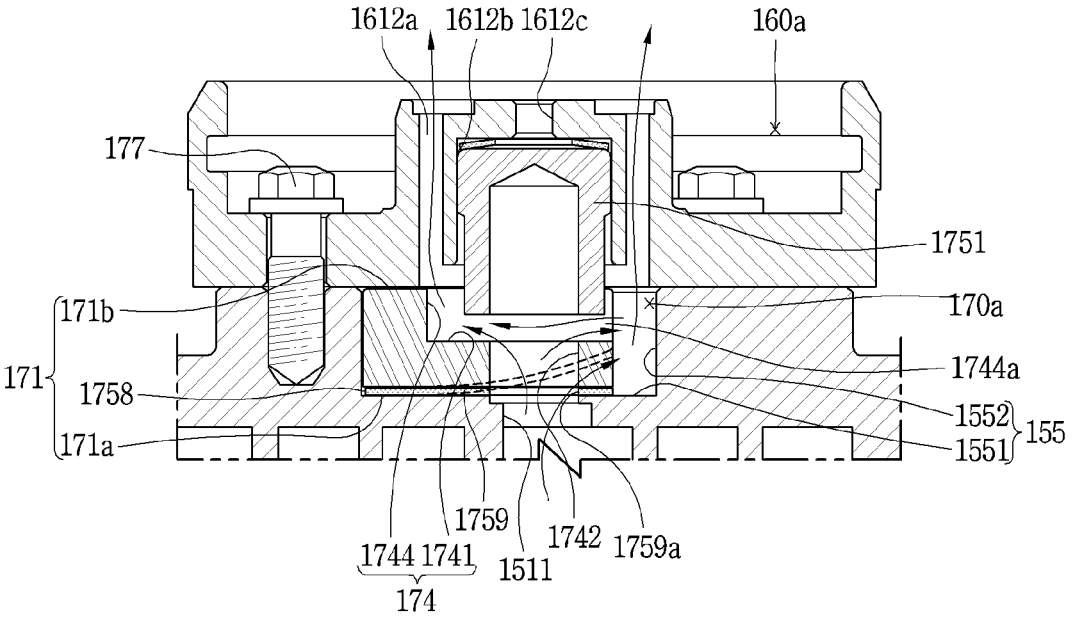
FIG. 15 is a cross-sectional view schematically illustrating a flow state of refrigerant that passes through a discharge port and a bypass hole in a scroll compressor according to an embodiment.

FIG. 15 is a cross-sectional view schematically illustrating a flow state of refrigerant that passes through a discharge port and a bypass hole in a scroll compressor according to an embodiment. Referring to FIG. 15, when the pressure in the first compression chamber V1 and the pressure in the second compression chamber V2 are higher than a set or predetermined pressure, the refrigerant compressed in the first compression chamber V1 moves to the first bypass hole 1512*a*, and the refrigerant in the second compression chamber V2 moves to the second bypass hole 1512*b*. The refrigerant moving to these bypass holes 1512*a* and 1512*b* push up the first opening/closing portion 756*b* of the first bypass valve 1756 and the second opening/closing portion 1757*b* of the second bypass valve 1757 that close the first bypass hole 1512*a* and the second bypass hole 1512*b*. The first opening/closing portion 1756*b* is bent based on the first fixing portion 1756*a* and the second opening/closing portion 1757*b* is bent based on the second fixing portion 1757*a* to open the first bypass hole 1512*a* and the second bypass hole 1512*b*. At this time, an open degree of the first opening/closing portion 1756*b* is limited by the first valve opening/closing surface 1731*b* of the retainer block 171, and an open degree of the second opening/closing portion 1757*b* is limited by the second valve opening/closing surface 1732*b* of the retainer block 171.

The refrigerant in the first compression chamber V1 and the refrigerant in the second compression chamber V2 exhaust through the first bypass hole 1512*a* the second bypass hole 1512*b*, respectively. The refrigerant moves toward the discharge valve accommodating portion 174 through the discharge guide passage 170*a* which is a space between the retainer block 171 and the block insertion groove 155. The refrigerant flows to the high-pressure portion 110*b* through the intermediate discharge port 1612*a* of the back pressure plate 161 together with the refrigerant discharged to the discharge valve accommodating portion 174 through the discharge guide hole 1742. Accordingly, the refrigerant compressed in the compression chamber V may be suppressed or prevented from being overcompressed to a set or predetermined pressure or higher, thereby suppressing or preventing damage to the orbiting wrap 142 and/or the non-orbiting wrap 152 and improving compressor efficiency.

Thereafter, when overcompression of the compression chamber V is resolved to restore proper pressure, the first opening/closing portion 1756*b* of the first bypass valve 1756 becomes unbent (unfolded) based on the first fixing portion 1756*a*, and the second opening/closing portion 1757*b* of the second bypass valve 1757 becomes unbent based on the second fixing portion 1757*a*, thereby closing the first bypass hole 1512*a* and the second bypass hole 1512*b*. The series of processes is repeated. At this time, high-pressure refrigerant that has not yet been discharged is trapped in the first bypass hole 1512*a* and the second bypass hole 1512*b*. As the pressure in the compression chamber V rises unnecessarily, the first bypass hole 1512*a* and the second bypass hole 1512*b* form a kind of dead volume. Therefore, it is advantageous in view of decreasing the dead volume to reduce the lengths of the first bypass hole 1512*a* and the second bypass hole 1512*a* by forming the non-orbiting end plate 151 having the first bypass hole 1512*a* and the second bypass hole 1512*b* to be as thin as possible.

However, in the case in which the bypass valve 1755 is fastened to the non-orbiting end plate 151 as in the related art, a minimum fastening thickness for fastening the bypass valve 1755 is required, and this has a limitation in reducing the thickness of the non-orbiting end plate 151. As described above, in this embodiment, the bypass valve 1755 is fastened to the valve assembly 170 that is disposed between the rear surface 151*a* of the non-orbiting end plate 151 and the rear surface 161*a* of the back pressure plate 161 facing the rear surface 151*a*. This may allow the non-orbiting end plate 151, in which the bypass holes 1512*a* and 1512*b* are formed, to be formed as thin as possible. Accordingly, the dead volume in the first bypass hole 1512*a* and the second bypass hole 1512*b* may be minimized by minimizing the lengths of the first bypass hole 1512*a* and the second bypass hole 1512*b*. Through this, an amount of refrigerant remaining in the first bypass hole 1512*a* and the second bypass hole 1512*b* may be minimized, thereby enhancing compression efficiency.

Hereinafter, description will be given of a valve assembly according to another embodiment. That is, in the previous embodiments, the discharge valve seating surface is formed as the discharge valve accommodating groove of the retainer block is recessed, but in some cases, the discharge valve seating surface may be excluded as the discharge valve accommodating groove is formed in a penetrating manner.

Figure 16:
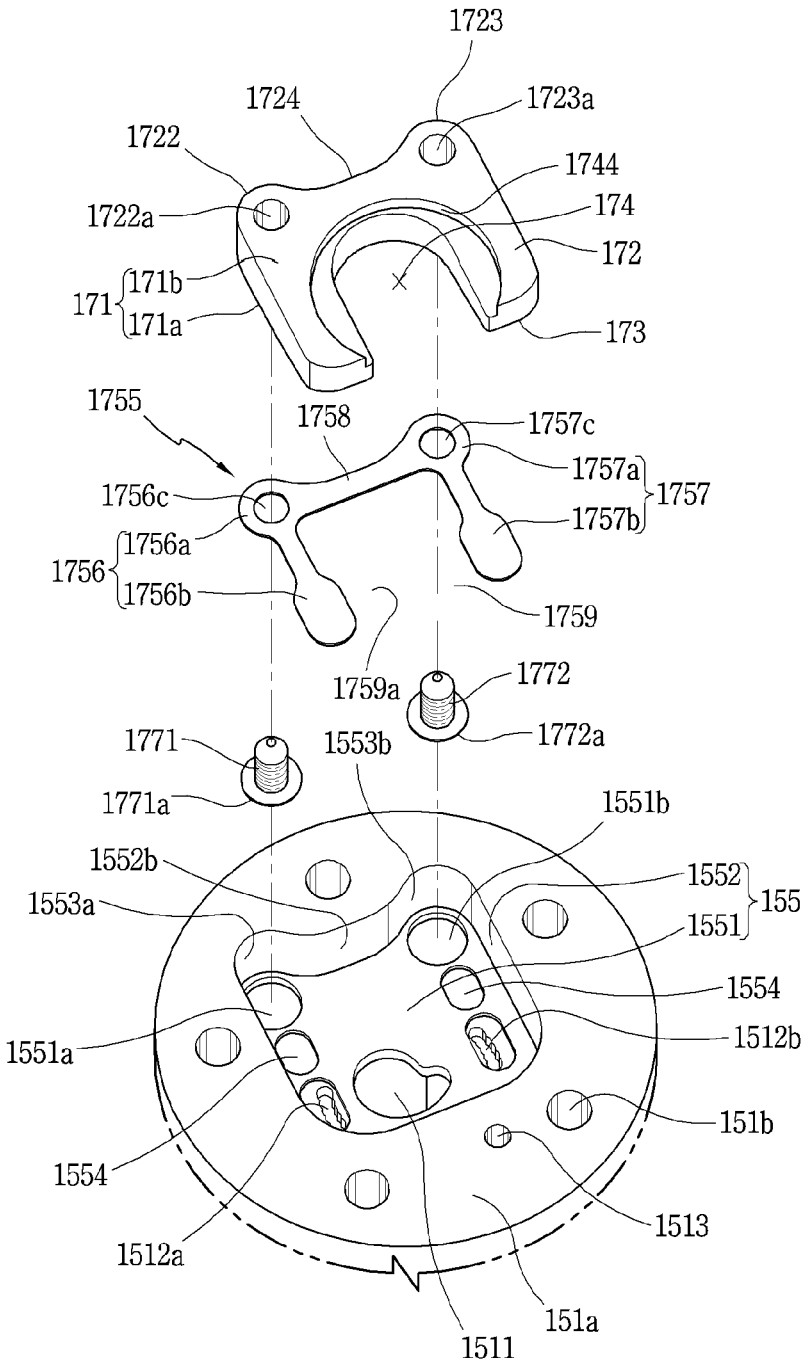
FIG. 16 is an exploded perspective view of a valve assembly in accordance with another embodiment.
Figure 17:
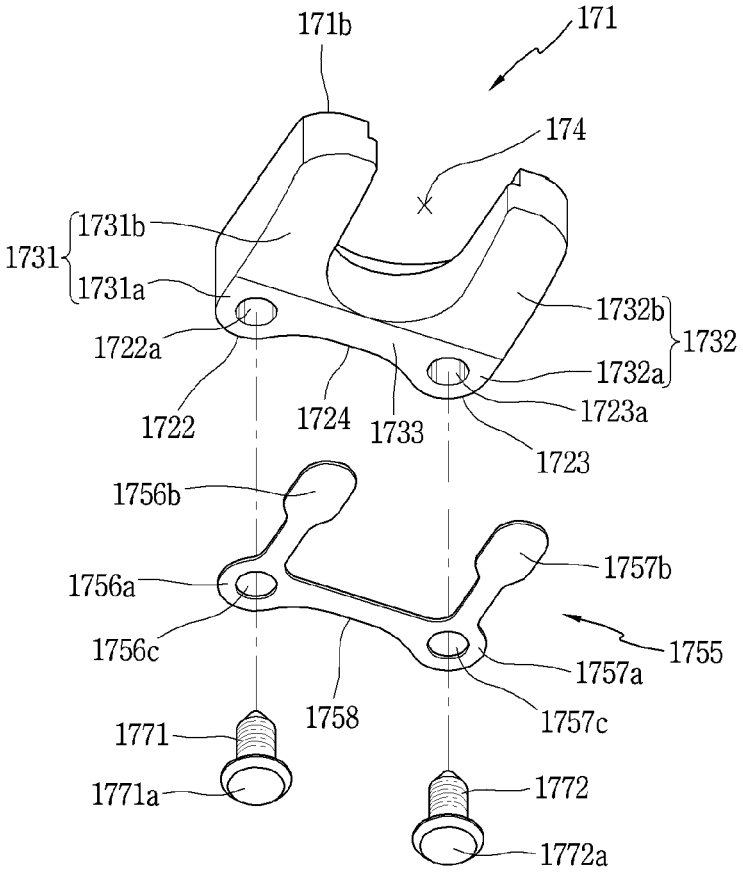
FIG. 17 is an exploded perspective view of the valve assembly of FIG. 16, viewed from a first axial side surface.

FIG. 16 is an exploded perspective view of a valve assembly in accordance with another embodiment. FIG. 17 is an exploded perspective view of the valve assembly of FIG. 16, viewed from a first axial side surface, and FIG. 18 is a cross-sectional view illustrating an assembled state of the valve assembly of FIG. 17.

Referring back to FIG. 1, the scroll compressor according to this embodiment includes the casing 110, the drive motor 120, the main frame 130, the orbiting scroll 140, the non-orbiting scroll 150, and the back pressure chamber assembly 160. The valve assembly 170 is disposed between the non-orbiting scroll 150 and the back pressure chamber assembly 160. The basic configuration of the non-orbiting scroll 150 and the back pressure assembly 160 including the valve assembly 170 and their operational effects are similar to those of the previous embodiment.

For example, block insertion groove 155 is recessed by a preset or predetermined depth into a central portion of the rear surface 151*a* of the non-orbiting end plate 151, and the valve assembly 170 may be inserted into the block insertion groove 155 to be fixed by being pressed between the non-orbiting scroll 150 and the back pressure chamber assembly 160. Accordingly, the valve assembly 170 may be firmly fixed between the non-orbiting scroll 150 and the back pressure chamber assembly 160 without using a separate fastening member.

Figure 18:
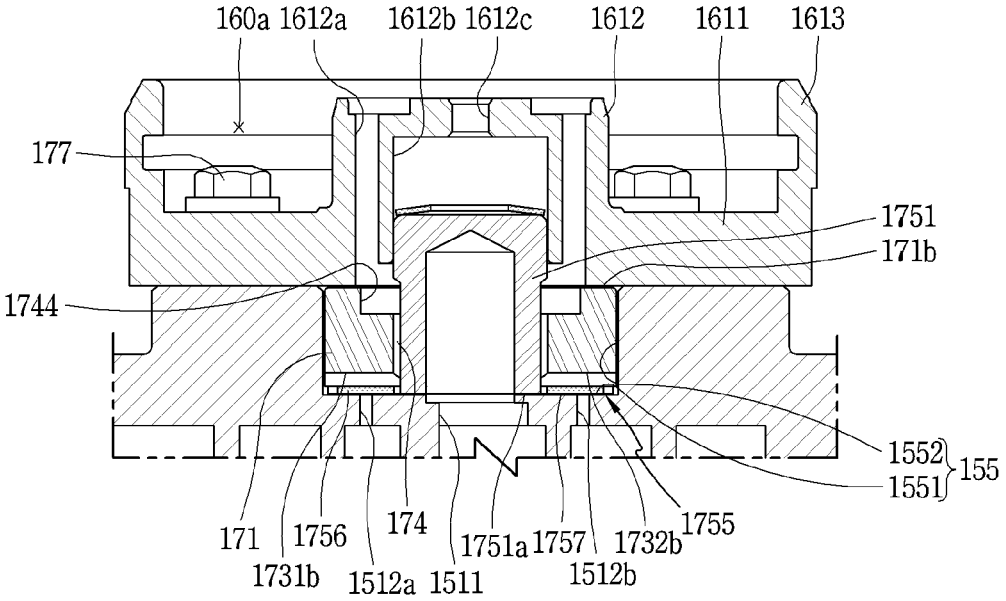
FIG. 18 is a cross-sectional view illustrating an assembled state of the valve assembly of FIG. 17.

Referring to FIGS. 16 to 18, the valve assembly 170 may include the retainer block 171 and the bypass valve 1755, and the bypass valve 1755 may be fastened to the retainer block 171. Accordingly, the non-orbiting end plate 151 may be made thinner than that when the bypass valve 1755 is fastened to the non-orbiting end plate 151.

The discharge port 1511 and the bypass holes 1512*a* and 1512*b* may be formed in the non-orbiting end plate 151, and the discharge port 1511 and the bypass holes 1512*a* and 1512*b* may be located inside of the block insertion groove 155. Accordingly, as the length of the discharge port 1511 and the lengths of the bypass holes 1512*a* and 1512*b* are shortened, the dead volume due to the discharge port 1511 and the bypass holes 1512*a* and 1512*b* may decrease. In particular, the discharge valve accommodating portion 174 may be formed axially through the retainer block 171 according to this embodiment, so that the opening/closing surface 1751*a* of the discharge valve 1751 may be formed on the rear surface 151*a* of the non-orbiting end plate 151. Accordingly, an actual length of the discharge port 1511 may be shortened by the thickness of the discharge valve accommodating portion 174, compared to the previous embodiment.

The basic configuration of the retainer block 171 according to this embodiment is similar to that of the previous embodiment. In other words, the retainer block 171 according to the embodiment may include the block body 172, the bypass valve support 173, and the discharge valve accommodating portion 174. The block body 172 and the bypass valve support 173 may be formed almost the same as those of the previous embodiment.

However, the discharge valve accommodating portion 174 may be formed through the block body 172 in the axial direction, unlike that in the previous embodiment. For example, the discharge valve accommodating portion 174 may be formed in a central portion of the block body 172 and may be formed through between both side surfaces of the block body 172 in the axial direction. Accordingly, the first valve support 1731 and the second valve support 1732 constituting the bypass valve support 173 are connected to each other by the first block fixing surface 1733 on the opposite side of the discharge guide passage 170*a*, while the first valve support 1731 and the second valve support 1732 are spaced apart from each other due to the exclusion of the second block fixing surface 1743 of the previous embodiment on the side of the discharge guide passage 170*a*.

As described above, in the case in which the discharge valve accommodating portion 174 is formed through the block body 172 in the axial direction, when the discharge valve 1751 is closed, the opening/closing surface 1751*a* of the discharge valve 1751 is brought into contact with the block insertion groove 155 of the non-orbiting scroll 150, more specifically, the block seating surface 1551. Accordingly, the discharge guide hole 1742 in the previous embodiment is excluded, and as described above, the actual length of the discharge port 1511 is shortened by the length of the discharge guide hole 1742 in the previous embodiment. Through this, the dead volume in the discharge port 1511 as well as the dead volume in the bypass holes 1512*a* and 1512*b* may decrease, thereby further improving compressor efficiency.

In addition, as the discharge valve accommodating portion 174 is formed through the block body 172 in the axial direction, the sealing connection portion 1759 may be excluded or the valve connection portion 1758 and the sealing connection portion 1759 may all be excluded from the bypass valve 1755. Accordingly, a fastening position of the bypass valve 1755 may be maintained and the structure of the bypass valve 1755 may be simplified, so as to reduce manufacturing costs or increase a degree of design freedom of the bypass valve 1755.

For example, when the sealing connection portion 1759 is excluded from the bypass valve 1755, the first bypass valve 1756 and the second bypass valve 1757 are still connected by the valve connection portion 1758 as in the previous embodiment. This may suppress or prevent misalignment of the bypass valve 1755 due to a fastening moment when the bypass valve 1755 is fastened.

On the other hand, when both the valve connection portion 1758 and the sealing connection portion 1759 are excluded from the bypass valve 1755, the first bypass valve 1756 and the second bypass valve 1757 are formed independently. Therefore, depending on the need, types (for example, one side is a reed valve and the other side is a piston valve), elastic force, assembly positions, or assembly forms of the first bypass valve 1756 and the second bypass valve 1757 may be freely adjusted or changed.

Hereinafter, description will be given of a valve assembly according to still another embodiment. That is, in the previous embodiments, the valve assembly is assembled in a state of being separated from the back pressure chamber assembly and/or the non-orbiting scroll, but in some cases, the valve assembly may be assembled in a state of being fastened to the back pressure chamber assembly and/or the non-orbiting scroll.

Figure 19:
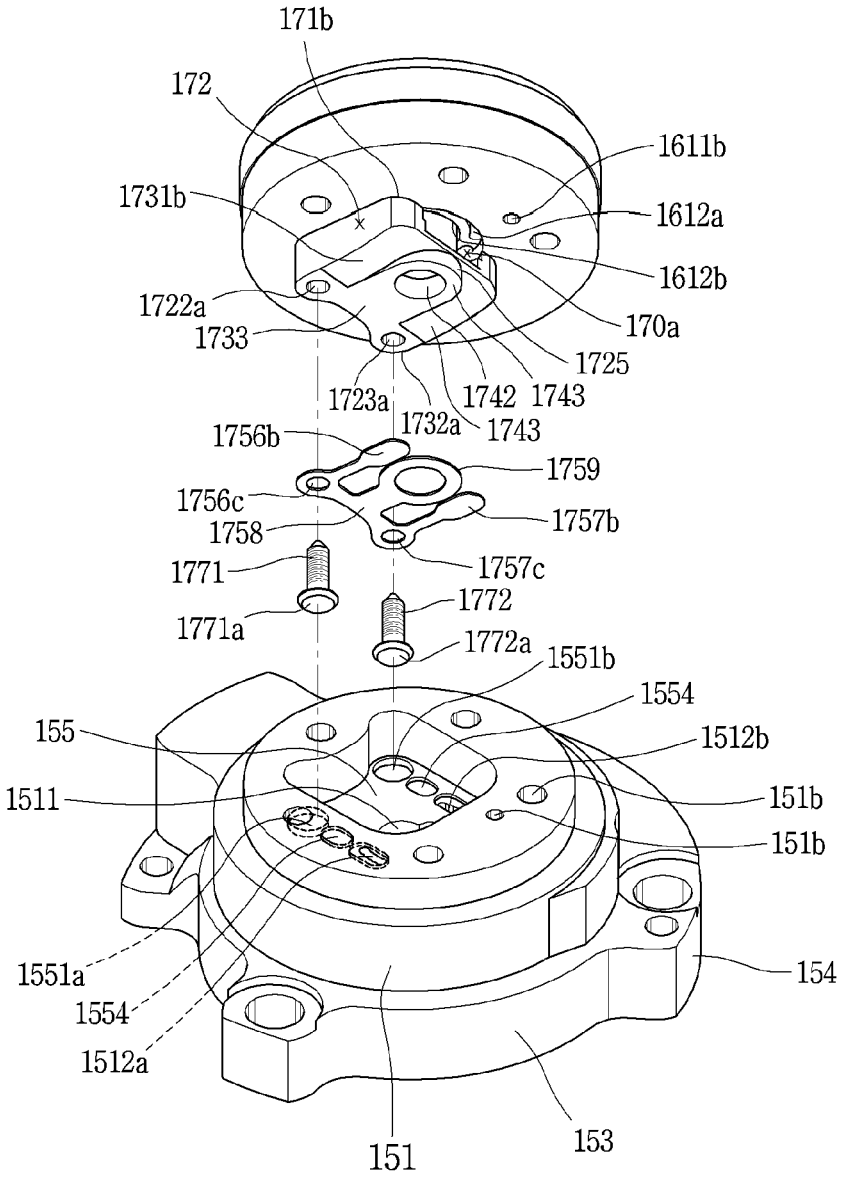
FIG. 19 is an exploded perspective view of a valve assembly in accordance with still another embodiment.
Figure 20:
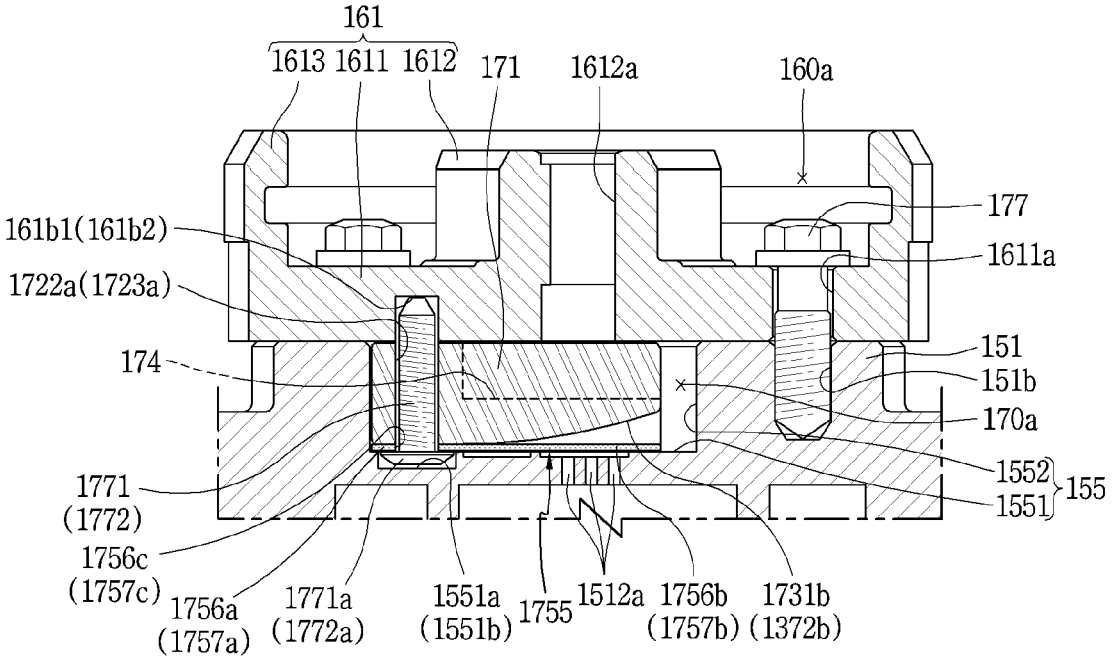
FIG. 20 is a cross-sectional view illustrating an assembled state of the valve assembly of FIG. 19.

FIG. 19 is an exploded perspective view of a valve assembly in accordance with still another embodiment. and FIG. 20 is a cross-sectional view illustrating an assembled state of the valve assembly of FIG. 19.

Referring back to FIG. 1, the scroll compressor according to this embodiment includes the casing 110, the drive motor 120, the main frame 130, the orbiting scroll 140, the non-orbiting scroll 150, and the back pressure chamber assembly 160. The valve assembly 170 is disposed between the non-orbiting scroll 150 and the back pressure chamber assembly 160. The basic configuration of the non-orbiting scroll 150 and the back pressure assembly 160 including the valve assembly 170 and their operational effects may be similar to those of the previous embodiment.

For example, the block insertion groove 155 may be recessed by the preset depth into the central portion of the rear surface 151*a* of the non-orbiting end plate 151, and the discharge port 1511 and the bypass holes 1512*a* and 1512*b* may be formed through the non-orbiting end plate 151 inside of the block insertion groove 155. The valve assembly 170 may include the retainer block 171 and the valve member 175, and the bypass valve 1755 constituting a portion of the valve member 175 may be fastened to the retainer block 171. Accordingly, the lengths of the discharge port 1511 and the bypass holes 1512*a* and 1512*b* may be reduced by forming the non-orbiting end plate 151 to be thin. Through this, the dead volume in the discharge port 1511 and the bypass holes 1512*a* and 1512*b* may decrease.

In addition, the discharge valve accommodating portion 174 may be formed in the retainer block 171. The discharge valve accommodating portion 174 may be recessed in the axial direction into the upper surface of the retainer block 171 by a preset or predetermined depth as in the embodiment of FIG. 3, or may be formed through the upper surface of the retainer block 171 in the axial direction as in the embodiment of FIG. 16. In the former case, the discharge valve 1751 may be modularized with the valve assembly 170, and in the latter case, the dead volume may decrease by reducing the lengths of the discharge port 1511 and the bypass holes 1512*a* and 1512*b*.

Also, in this embodiment, the valve assembly 170 may be inserted into the block insertion groove 155 and disposed between the non-orbiting scroll 150 and the back pressure chamber assembly 160. However, in this embodiment, the valve assembly 170 may integrally extend from the lower surface of the back pressure chamber assembly 160, that is, from the rear surface 161*a* of the back pressure plate 161 that faces the second axial side surface 171*b* as the upper surface of the retainer block 171 or may be fastened to the rear surface (lower surface) 161*a* of the back pressure plate 161 by a separate fastening member. This embodiment illustrates an example in which the second axial side surface 171*b* of the retainer block 171 is fastened to the rear surface 161*a* of the back pressure plate 161 by fastening members 1771 and 1772.

Referring to FIGS. 19 and 20, the basic configuration of the retainer block 171 according to this embodiment is similar to that of the previous embodiment. In other words, the retainer block 171 according to the embodiment may include the block body 172, the discharge valve accommodating portion 174, and the bypass valve support 173. The block body 172 and the bypass valve support 173 may be formed almost the same as those of the previous embodiment.

For example, the block body 172 may include the first valve fastening protrusion 1722 and the second valve fastening protrusion 1723. The first valve fastening protrusion 1722 may include first valve fastening hole 1722*a* and the second valve fastening protrusion 1723 may include second valve fastening hole 1723*a*, respectively. The first fastening member 1771 that passes through the first valve through-hole 1756*c* of the bypass valve 1755 may be inserted into the first valve fastening hole 1722*a*, and the second fastening member 1772 passing through the second valve through-hole 1757*c* of 1755 of the bypass valve 1755 may be inserted into the second valve fastening hole 1723*a*. The first fastening member 1771 may be fastened to a first fixing groove 161*b*1, which is disposed in the rear surface 161*a* of the back pressure plate 161, through the first valve fastening hole 1722*a*, while the second fastening member 1882 may be fastened to a second fixing groove 161*b*2, which is disposed in the rear surface 161*a* of the back pressure plate 161, through the second valve fastening hole 1723*a*.

In other words, in this embodiment, the retainer block 171 constituting the valve assembly 170 may be fastened to the back pressure plate 161. The retainer block 171 may be fastened to the back pressure plate 161 using the fastening members 1771 and 1772 for fastening the bypass valve 1755. This may unify fastening tasks of the bypass valve 1755 and the retainer block 171, thereby simplifying the number of assembly processes for the bypass valve 1755 and the retainer block 171.

Although not illustrated, the retainer block 171 may alternatively be fastened to the back pressure plate 161 using a separate fastening member other than the fastening members for fastening the bypass valve 1755 to the retainer block 171. In this case, by dualizing the fastening tasks of the bypass valve 1755 and the retainer block 171, a fastening shape or fastening position of the retainer block 171 may be diversified.

As described above, when the valve assembly 170 is fastened to the back pressure plate 161, the valve assembly 170 and the back pressure plate 161 may be modularized so that the valve assembly 170 may be easily assembled. In addition, as the valve assembly 170 is firmly fixed to the back pressure plate 161, misalignment of the valve assembly 170 in the block insertion groove 155 due to vibration that is generated during operation of the compressor may be prevented. In this way, compressor efficiency may be further improved.

Hereinafter, description will be given of a valve assembly according to still another embodiment. That is, in the previous embodiment, the discharge valve is configured as the piston valve, but in some cases, the discharge valve may alternatively be configured as a reed valve like the bypass valve.

Figure 21:
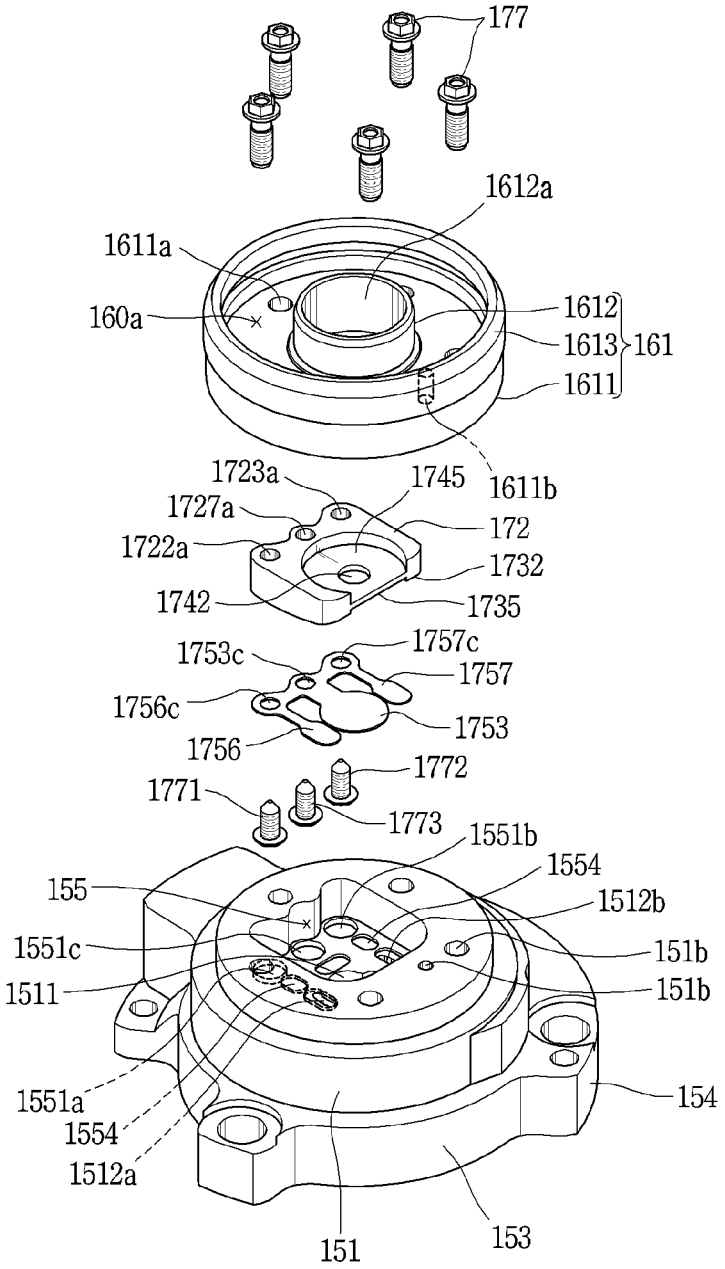
FIG. 21 is an exploded perspective view of a valve assembly in accordance with still another embodiment.
Figure 22:
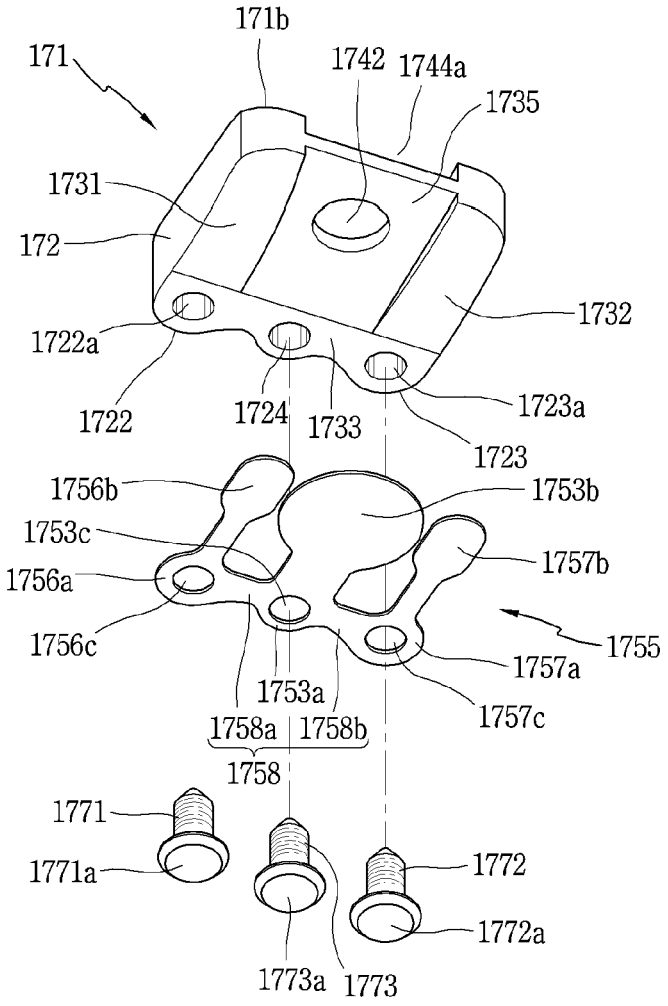
FIG. 22 is an exploded perspective view of the valve assembly of FIG. 21, viewed from a first axial side surface.

FIG. 21 is an exploded perspective view of a valve assembly in accordance with another embodiment. FIG. 22 is an exploded perspective view of the valve assembly of FIG. 21, viewed from a first axial side surface, and FIG. 23 is a cross-sectional view illustrating an assembled state of the valve assembly of FIG. 22.

Referring back to FIG. 1, the scroll compressor according to this embodiment may include casing 110, drive motor 120, main frame 130, orbiting scroll 140, non-orbiting scroll 150, and back pressure chamber assembly 160. Valve assembly 170 may be disposed between the non-orbiting scroll 150 and the back pressure chamber assembly 160. The basic configuration of the non-orbiting scroll 150 and the back pressure assembly 160 including the valve assembly 170 and their operational effects are similar to those of the previous embodiment, and repetitive disclosure has been omitted.

However, in this embodiment, instead of excluding the discharge guide protrusion 1725 illustrated in the embodiment of FIG. 4 from the first axial side surface 171*a* of the retainer block 171 constituting a portion of the valve assembly 170, discharge valve support portion (discharge valve support) 1735 is formed. Bypass valve support portions (bypass valve supports) 1731 and 1732 are disposed on both sides of the discharge valve support 1735 in the lateral direction, in the same manner as in the previous embodiment.

Figure 23:
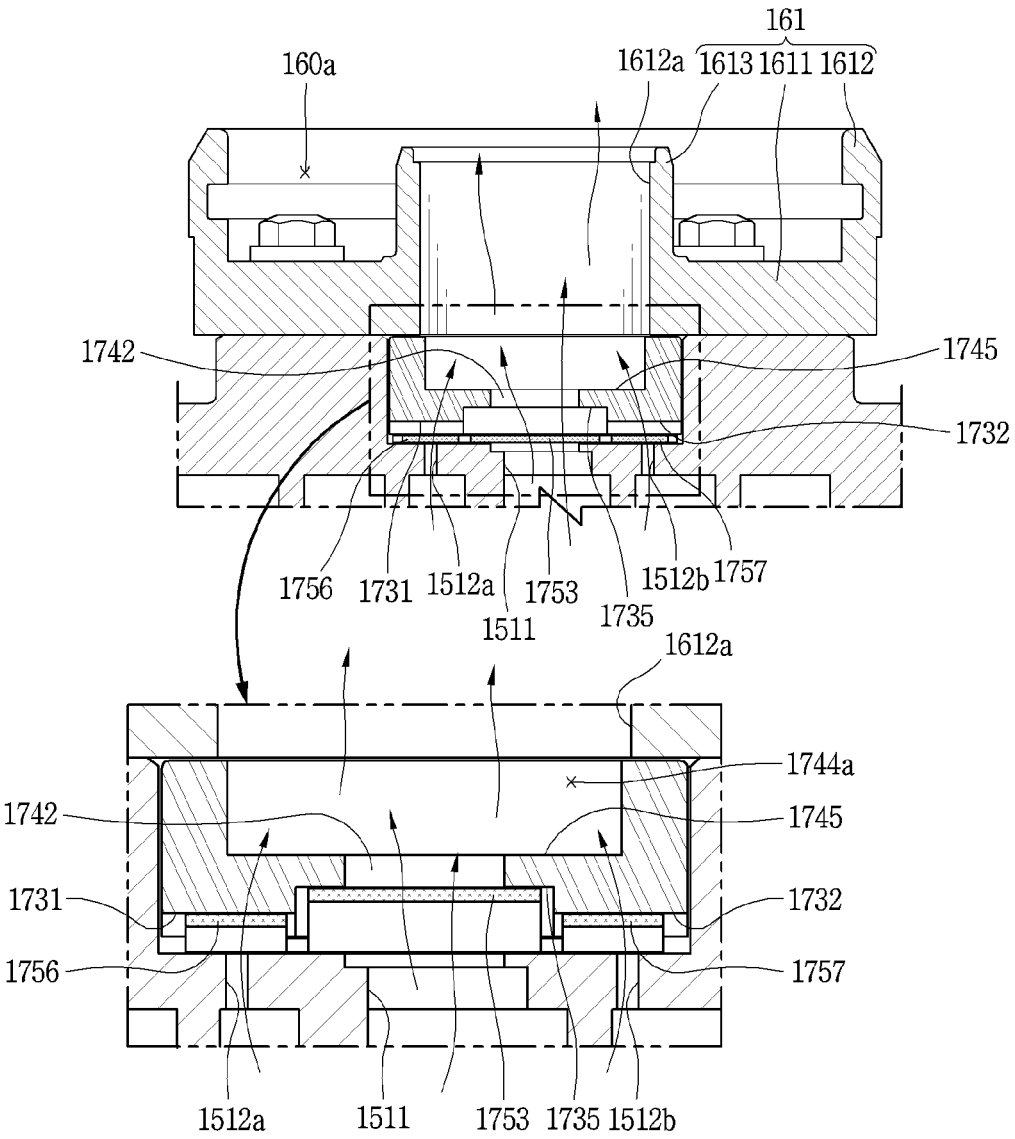
FIG. 23 is a cross-sectional view illustrating an assembled state of the valve assembly of FIG. 22.

Referring to FIGS. 21 to 23, first valve support 1731 and second valve support 1732 may be formed at a preset or predetermined interval in the lateral direction on the first axial side surface 171*a* of the retainer block 171, and the discharge valve support 1735 may be formed between the first valve support 1731 and the second valve support 1732, that is, on a central portion of the first axial side surface 171*a*. As the first valve support 1731 and the second valve support 1732 are the same as those of the embodiment of FIG. 4 described above, repetitive description thereof has been omitted.

The discharge valve support 1735 may have the same shape as the first valve support 1731 and/or the second valve support 1732, for example, may be inclined or curved to be more spaced apart from block seating surface 1551 toward discharge guide passage 170*a*. Accordingly, a third opening/closing portion 1753*b* of discharge valve 1753, which will be described hereinafter, may be opened or closed while being gently bent or unbent (unfolded), thereby suppressing or preventing valve knocking noise from being generated when the discharge valve 1753 is opened or closed.

However, considering that discharge port 1511 is formed wider than each of bypass holes 1512*a* and 1512*b*, the discharge valve support 1735 may be deeper than the first valve support 1731 and/or the second valve support 1732. In other words, the discharge valve support 1735 may be inclined at a greater inclination angle or may be curved with a greater curvature than the first valve support 1731 and/or the second valve support 1732. Accordingly, the opening/closing portion 1753*b* of the discharge valve 1753 may be open wider than the opening/closing portions 1756*b* and 1757*b* of the respective bypass valves 1756 and 1757, which may result in lowering discharge resistance in the discharge port 1511 which is wider than the bypass holes 1512*a* and 1512*b*.

In addition, as illustrated in FIGS. 21 and 22, the discharge valve support 1735 may include a discharge guide hole 1742 that is formed therethrough toward a discharge guide groove 1745 described hereinafter. An inner diameter of the discharge guide hole 1742 may be smaller than an outer diameter of the third opening/closing portion 1753*b* of the discharge valve 1753 described hereinafter. Accordingly, the discharge guide hole 1742 is located behind the discharge valve 1753, that is, at a side of a compression rear surface of the discharge valve 1753. This may reduce a collision area with the discharge valve 1753 and simultaneously serve as a buffer space when the discharge valve 1753 is opened, thereby reducing valve knocking noise. In addition, the discharge guide hole 1742 may serve as the discharge guide passage 170*a*, thereby lowering discharge resistance in the block insertion groove 155.

The discharge guide groove 1745 may be formed in the second axial side surface 171*b* of the retainer block 171. The discharge guide groove 1745 may be formed to have a circular cross section or a rectangular cross section to communicate with the intermediate discharge port 1612*a*. A discharge passage groove 1744*a* may be formed in a portion of an inner circumferential surface of the discharge guide groove 1745 to be open toward the block accommodating surface 1552 of the block insertion groove 155. Accordingly, the discharge guide groove 1745 may communicate with the discharge guide passage 170*a* through the discharge passage groove 1744*a*.

On the other hand, as the discharge valve 1753 according to this embodiment is configured as a reed valve, the discharge valve 1753 may be formed integrally with the bypass valves 1756 and 1757, or may be formed independently of the bypass valves 1756 and 1757. Referring to FIG. 22, the discharge valve 1753 may integrally extend from a middle between the both bypass valves 1756 and 1757, that is, from a middle of valve connection portion 1758 by which first fixing portion 1756*a* of the first bypass valve 1756 and second fixing portion 1757*a* of the second bypass valve 1757 are connected to each other.

More specifically, valve member 175 may include a first bypass valve 1756, second bypass valve 1757, and discharge valve 1753. The first bypass valve 1756 may be disposed to face first bypass hole 1512*a*, the second bypass valve 1757 may be disposed to face second bypass hole 1512*b*, and the discharge valve 1753 is disposed to face the discharge port 1511, respectively, in the axial direction. As the first bypass valve 1756 and the second bypass valve 1757 may be the same as or similar to those in the previous embodiment, repetitive description thereof has been omitted.

The discharge valve 1753 may include a third fixing portion 1753*a* and a third valve portion 1753*b*. The third fixing portion 1753*a* may be located between the first fixing portion 1756*a* and the second fixing portion 1757*a*, and one (first) side of the third fixing portion 1753*a* in the circumferential direction may be connected to a first valve connection portion 1758*a* that extends from the first fixing portion 1756*a*, and another (second) side of the third fixing portion 1753*a* may be connected to a second valve connection portion 1758*b* that extends from the second fixing portion 1757*a*. Accordingly, the third fixing portion 1753*a* may be integrally connected to the first fixing portion 1756*a* and the second fixing portion 1757*a* by the first valve connection portion 1758*a* and the second valve connection portion 1758*b*.

A third valve through-hole 1753*c* may be formed through the third fixing portion 1753*a*. The third valve through-hole 1753*c* may be fastened to the third valve fastening hole 1727*a* formed through the first axial side surface 171*a* of the retainer block 171 by a third fastening member 1773. Accordingly, the discharge valve 1753 may be firmly fixed to the retainer block 171.

In this case, a third fastening member accommodating groove 1551*c* into which a head 1773*a* of the third fastening member 1773 is inserted may be formed near the discharge port 1511, that is, in the block seating surface 1551 facing the discharge valve 1753. The third fastening member accommodating groove 1551*c* may alternatively be formed only in the block seating surface 1551, like the first fastening member accommodating groove 1551*a* and/or the second fastening member accommodating groove 1551*b* in the previous embodiment, only in the first axial side surface 171*a* of the retainer block 171, or partially in each of the block seating surface 1551 and the first axial side surface 171*a* of the retainer block 171. Description thereof will be replaced with the description of the first fastening member accommodating groove 151*a* and/or the second fastening member accommodating groove 1551*b* illustrated in the previous embodiments of FIGS. 3 and 7.

As described above, when the discharge valve 1753 is configured as the reed valve and fixed to the first axial side surface 171*a* of the retainer block 171, the discharge valve 1753 opens and closes the discharge port 1511 while being in contact with or separated from the block seating surface of the block insertion groove 155. Accordingly, the length of the discharge guide hole 1742 in the previous embodiment of FIG. 6 is not included in a discharge length, and only the discharge hole 1511 defines the actual discharge length. Through this, the length L1 of the discharge port 1511 may be shortened by the length L2 of the bypass holes 1512*a* and 1512*b*, thereby decreasing the dead volume in the discharge port 1511.

In addition, when the discharge valve 1753 is formed integrally with the first bypass valve 1756 and the second bypass valve 1757, the valve member 175 may be formed as a single body, which may facilitate machining and assembling for the valve member 175. Although using the individual fastening members 1771, 1772, and 1773 that fastens the discharge valve 1753 as well as the first bypass valve 1756 and the second bypass valve 1757, respectively, an effect of using the fastening members by three for each of the valves 1756, 1757, and 1753 may be obtained. This may more effectively prevent misalignment of the valves 1756, 1757, and 1753 during fastening operation of the valve member 175 and/or operation of the compressor.

In addition, as the discharge valve 1753 is configured as the reed valve and disposed on the first axial side surface 171*a* of the retainer block 171, the back pressure plate 161 does not need the valve guide groove 1612*b* illustrated in the previous embodiments. Accordingly, the valve guide groove 1612*b* may be excluded from the back pressure plate 161, and thus, the intermediate discharge port 1612*a* may be formed in a cylindrical shape. This may simplify the structure of the back pressure plate 161 and facilitate manufacturing of the back pressure plate 161, thereby enlarging an area of the intermediate discharge port 1612*a* and lowering discharge resistance.

Although not illustrated, the discharge valve 1753 may be configured as the reed valve but may be formed separately from the first bypass valve 1756 and the second bypass valve 1757. For example, the first bypass valve 1756 and the second bypass valve 1757 may be connected to each other by valve connection portion 1728, and the discharge valve 1753 may be independently fastened while being spaced apart from the valve connection portion 1728. In this case, while the entire valve member 175 is configured as the reed valve, the discharge valve 1753 may be freely designed as needed, to be different from the first bypass valve 1756 and/or the second bypass valve 1757 in view of shape, elasticity, assembly position, for example.

Although not illustrated, the discharge valve 1753 as well as the first bypass valve 1756 and the second bypass valve 1757 may be, of course, formed separately from one another. For example, the first bypass valve 1756, the second bypass valve 1757, and the discharge valve 1753 may be formed independently of one another, to be fastened to the first axial side surface 171*a* of the retainer block 171 by respective fastening members 1771, 1772, and 1773. In this case, while the entire valve member 175 is configured as the reed valve, the discharge valve 1753 may be freely determined in shape, elasticity, and assembly position, for example, for the first bypass valve 1756 and/or the second bypass valve 1757, as needed.

On the other hand, as described above, embodiments of the valve assembly may be equally applied to an open type as well as a hermetic type, to a high-pressure type as well as a low-pressure type, and even to a horizontal (lateral) type as well as a vertical type. These embodiments disclosed herein may also be equally applied to an orbiting back pressure type or a tip seal type as well as the non-orbiting back pressure type. In particular, in the orbiting back pressure type or the tip seal type, a separate plate, instead of the back pressure chamber assembly, may be fixed to the rear surface of the non-orbiting scroll (fixed scroll), and the valve assembly of the previous embodiments may be fixed by using the plate. Even in this embodiment, the basic configuration of the valve assembly or operational effect thereof may be substantially the same as those of the previous embodiments.

Embodiments disclosed herein provide a scroll compressor capable of suppressing or preventing overcompression and decreasing a dead volume in a compression chamber. Embodiments disclosed herein also provide a scroll compressor capable of reducing a length of a bypass hole, and thus, decreasing a dead volume in the bypass hole.

Embodiments disclosed herein provide a scroll compressor capable of securing a coupling length for a bypass valve while reducing a length of a bypass hole. Embodiments disclosed herein further provide a scroll compressor capable of decreasing a dead volume in a discharge port. Embodiments disclosed herein provide furthermore provide a scroll compressor capable of reducing a length of a discharge port so as to decrease a dead volume in the discharge port.

Embodiments disclosed herein provide a scroll compressor capable of quickly discharging refrigerant that passes through a discharge port. Embodiments disclosed herein further provide a scroll compressor capable of facilitating assembling between a bypass valve and a discharge valve. Embodiments disclosed herein furthermore provide a scroll compressor capable of modularizing a bypass valve and a discharge valve to enhance assembly property and assembly reliability for the bypass valve and the discharge valve. Embodiments disclosed herein also provide a scroll compressor capable of quickly discharging refrigerant that passes through a bypass hole and a discharge port while modularizing a bypass valve and a discharge valve.

Embodiments disclosed herein provide a scroll compressor that may include a casing, a rotary shaft, an orbiting scroll, a non-orbiting scroll, and a back pressure chamber assembly. The orbiting scroll may perform an orbiting motion by being coupled to the rotary shaft in an inner space of the casing. The non-orbiting scroll may be engaged with the orbiting scroll to define a compression chamber, and may include a discharge port and bypass holes through which refrigerant in the compression chamber may be discharged. The back pressure chamber assembly may be coupled to a rear surface of the non-orbiting scroll to press the non-orbiting scroll toward the orbiting scroll. A block insertion groove may be recessed into the rear surface of the non-orbiting scroll by a preset or predetermined depth to accommodate the discharge port and the bypass hole therein. A retainer block including a bypass valve that opens and closes the bypass holes may be fixedly inserted into the block insertion groove. The bypass valve may be fixed to a first axial side surface of the retainer block facing the block insertion groove. Through this, the bypass valve that suppresses or prevents overcompression of a compression chamber is not fastened to a non-orbiting end plate, which may allow the non-orbiting end plate to be reduced in thickness. This may shorten lengths of the bypass holes and the discharge port by the reduced thickness of the non-orbiting end plate, thereby decreasing a dead volume in the bypass holes and the discharge port.

For example, the bypass valve may include a fixing portion fixed between the block insertion groove and the retainer block facing the block insertion groove, and an opening/closing portion that extends from the fixing portion to open and close the bypass hole while being bent or unbent with respect to the fixing portion. The fixing portion may be fastened to the first axial side surface of the retainer block. With this configuration, the bypass valve configured as a reed valve may be stably fixed to the retainer block.

More specifically, the retainer block may have a bypass valve support portion (bypass valve support) disposed on the first axial side surface. The bypass valve support portion may include a valve fixing surface fixed to the block insertion groove as the fixing portion is fastened thereto, and a valve opening/closing surface that extends from the valve fixing surface in a curved or inclined manner so as to be spaced apart from the block insertion groove, and that supports the opening/closing portion. This may reduce an impact with the opening/closing portion when opening and closing the opening/closing portion of the bypass valve so as to reduce valve knocking noise and simultaneously lower flow resistance for refrigerant flowing from the bypass hole to the intermediate discharge port, such that the refrigerant may be quickly discharged.

The compression chamber may include a first compression chamber and a second compression chamber, and the bypass holes may include a first bypass hole that communicates with the first compression chamber and a second bypass hole that communicates with the second compression chamber. The bypass valve may include a first bypass valve part (first bypass valve) that opens and closes the first bypass hole, a second bypass valve part (second bypass valve) that opens and closes the second bypass hole, and a valve connection part or portion that connects the first bypass valve part and the second bypass valve part. This may unify a plurality of bypass valves to facilitate assembly of the bypass valves and simultaneously suppress or prevent misalignment due to distortion of the bypass valves during the opening/closing operation of the valves.

More specifically, the first bypass valve part may include a first fixing portion fixed to the retainer block and a first opening/closing portion that extends from the first fixing portion to open and close the first bypass hole. The second bypass valve part may include a second fixing portion fixed to the retainer block and a second opening/closing portion that extends from the second fixing portion to open and close the second bypass hole. A valve connection part or portion may connect the first fixing portion and the second fixing portion. This may unify a plurality of bypass valves and secure a long length of the bypass valves, thereby increase a valve response.

More specifically, a first valve through-hole may be formed through the first fixing portion, and a second valve through-hole may be formed through the second fixing portion. The first fixing portion may be fixed to the retainer block by a first fastening member inserted through the first valve through-hole, and the second fixing portion may be fixed to the retainer block by a second fastening member inserted through the second valve through-hole. Fastening member accommodating grooves into which a head of the first fastening member and a head of the second fastening member are inserted may be formed in at least one of the block insertion groove or the first axial side surface of the retainer block. Through this, the head of the fastening member that supports the bypass valve may be hidden even by applying the reed valve as the bypass valve, which may make the non-orbiting end plate having the discharge port and/or the bypass holes thin in thickness. This may result in reducing lengths of the discharge port and/or the bypass holes even while applying the reed-type bypass valve, thereby decreasing a dead volume in the discharge port and/or the bypass holes.

A discharge guide protrusion may extend axially from the retainer block toward the block insertion groove, and a discharge guide hole that communicates with the discharge port may be formed in the discharge guide protrusion. A sealing connection part or portion that extends between the block insertion groove and the discharge guide protrusion may be formed on the valve connection part. Through this, refrigerant discharged through the discharge port may quickly move to the intermediate discharge port, and at the same time, the retainer block may be stably fixed to the block sealing groove with the bypass valve interposed therebetween.

More specifically, the sealing connection part may include a discharge communication hole that communicates with the discharge guide hole. With this configuration, the discharge port and the discharge guide hole may be sealed from each other, such that refrigerant discharged through the discharge port may quickly move to the intermediate discharge port.

The compression chamber may include a first compression chamber and a second compression chamber, and the bypass holes may include a first bypass hole that communicates with the first compression chamber and a second bypass hole that communicates with the second compression chamber. The first bypass hole may be open and closed by a first bypass valve, and the second bypass hole may be open and closed by a second bypass valve. The first bypass valve and the second bypass valve may be provided independently of each other and all fastened to the retainer block. Through this, a shape, elasticity, and assembly position, for example, of the first bypass valve and/or the second bypass valve may be easily adjusted or changed as needed.

More specifically, the first bypass valve may include a first fixing portion fixed to the retainer block and a first opening/closing portion that extends from the first fixing portion to open and close the first bypass hole. The second bypass valve may include a second fixing portion fixed to the retainer block and a second opening/closing portion that extends from the second fixing portion to open and close the second bypass hole. A first valve through-hole may be formed through the first fixing portion, and a second valve through-hole may be formed through the second fixing portion. The first fixing portion may be fixed to the retainer block by a first fastening member inserted through the first valve through-hole, and the second fixing portion may be fixed to the retainer block by a second fastening member inserted through the second valve through-hole. This may make the first bypass valve and the second bypass valve stably fixed to the retainer block.

The back pressure chamber assembly may include a valve guide groove formed therein such that a discharge valve is slidably inserted therein, the retainer block may include a discharge valve accommodating portion in which the discharge valve is axially supported, and the discharge valve accommodating portion may include a discharge guide hole that communicates with the discharge port. The discharge valve may be disposed between the back pressure chamber assembly and the retainer block to open and close the discharge guide hole. This may modularize the discharge valve with the retainer block, to facilitate assembly for the discharge valve.

The back pressure chamber assembly may include a valve guide groove in which a discharge valve is slidably inserted, and the retainer block may include a discharge valve accommodating portion through which the discharge valve is inserted. The discharge valve may be inserted through the discharge valve accommodating portion to come into contact with the non-orbiting scroll, so as to open and close the discharge port. This may shorten the length of the discharge port, thereby reducing a dead volume in the discharge port.

A discharge valve that opens and closes the discharge port may be disposed between the block insertion groove and the first axial side surface of the retainer block facing the block insertion groove. The discharge valve may be fastened to the first axial side surface of the retainer block facing the block insertion groove. This may modularize the discharge valve with the retainer block to facilitate assembly for the discharge valve and simultaneously shorten the length of the discharge port so as to reduce a dead volume in the discharge port.

More specifically, the discharge valve may be formed integrally with the bypass valve. This may facilitate manufacturing and assembly of the discharge valve and the bypass valve.

The bypass valve may include a plurality of bypass valves spaced apart from each other, and a valve connection part or portion that connects the plurality of bypass valves. The discharge valve may include a discharge valve part that extends integrally from the valve connection part. This may facilitate manufacturing and assembly of the discharge valve and the bypass valve and secure valve lengths of those valves, thereby enhancing a valve response.

The discharge valve may be provided independently of the bypass valve. This may decrease a dead volume in the discharge port and the bypass holes and simultaneously easily adjust or change the shape, and elasticity, assembly position, for example, of the discharge valve and the bypass valve as needed.

A bypass valve support portion that supports the bypass valve and a discharge valve support portion (discharge valve support) that supports the discharge valve may be formed on the first axial side surface of the retainer block that faces the block insertion groove. The discharge valve support portion may be formed to be deeper than the bypass valve support portion. This may effectively reduce discharge resistance in the discharge port even though the discharge port is formed to be wider than the bypass holes.

The retainer block may be fixed in close contact with the rear surface of the non-orbiting scroll and a rear surface of the back pressure chamber assembly facing the same by a fastening force for fastening the non-orbiting scroll and the back pressure chamber assembly. Through this, as the retainer block may be fixed without a separate fastening member, the assembly process for the retainer block may be simplified.

The retainer block may be fastened to the rear surface of the back pressure chamber assembly facing the retainer block in the axial direction. As the retainer block is fastened to the back pressure chamber assembly, assembling property and assembly reliability of the retainer block may be improved.

More specifically, the bypass valve may be fastened to the retainer block by a fastening member for fastening the retainer block to the back pressure chamber assembly. As the bypass valve is fastened to the retainer block and at the same time the retainer block is fastened to the back pressure chamber assembly using the fastening member, the number of assembly processes including the retainer block may be reduced and misalignment may be prevented, thereby improving assembly reliability.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element (s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative to the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments are described herein with reference to cross-section illustrations that are schematic illustrations of idealized embodiments (and intermediate structures). As such, variations from the shapes of the illustrations as a result, for example, of manufacturing techniques and/or tolerances, are to be expected. Thus, embodiments should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A scroll compressor, comprising:

a casing;

an orbiting scroll coupled to a rotary shaft in an inner space of the casing to perform an orbiting motion;

a non-orbiting scroll engaged with the orbiting scroll to define a compression chamber, and provided with a discharge port and a plurality of bypass holes through which refrigerant in the compression chamber is discharged; and a back pressure chamber assembly coupled to a rear surface of the non-orbiting scroll to press the non-orbiting scroll toward the orbiting scroll, wherein a block insertion groove is recessed by a predetermined depth into the rear surface of the non-orbiting scroll to accommodate the discharge port and the plurality of bypass holes therein, and a retainer block having at least one bypass valve that opens and closes the plurality of bypass holes is fixedly inserted into the block insertion groove, wherein the at least one bypass valve is fixed to a first axial side surface of the retainer block facing the block insertion groove, wherein the compression chamber includes a first compression chamber and a second compression chamber, wherein the plurality of bypass holes include a first bypass hole that communicates with the first compression chamber and a second bypass hole that communicates with the second compression chamber, and wherein the at least one bypass valve comprises:

a first bypass valve that opens and closes the first bypass hole;

a second bypass valve that opens and closes the second bypass hole; and a valve connection portion that connects the first bypass valve and the second bypass valve, wherein a discharge guide protrusion extends axially from the retainer block toward the block insertion groove, wherein a discharge guide hole that communicates with the discharge port is formed in the discharge guide protrusion, and wherein a sealing connection portion that extends between the block insertion groove and the discharge guide protrusion is formed on the valve connection portion.

2. The scroll compressor of claim 1, wherein the at least one bypass valve comprises:

a fixing portion fixed between the block insertion groove and the retainer block facing the block insertion groove; and an opening/closing portion that extends from the fixing portion to open and close the plurality of bypass holes while being bent or unbent with respect to the fixing portion, and wherein the fixing portion is fastened to the first axial side surface of the retainer block.

3. The scroll compressor of claim 2, wherein the retainer block has a bypass valve support disposed on the first axial side surface, and wherein the bypass valve support comprises:

a valve fixing surface fixed to the block insertion groove as the fixing portion is fastened thereto; and a valve opening/closing surface that extends from the valve fixing surface in a curved or inclined manner so as to be spaced apart from the block insertion groove and supports the opening/closing portion.

4. The scroll compressor of claim 1, wherein the first bypass valve includes a first fixing portion fixed to the retainer block and a first opening/closing portion that extends from the first fixing portion to open and close the first bypass hole, wherein the second bypass valve includes a second fixing portion fixed to the retainer block and a second opening/closing portion that extends from the second fixing portion to open and close the second bypass hole, and wherein the valve connection portion connects the first fixing portion and the second fixing portion.

5. The scroll compressor of claim 4, wherein a first valve through-hole is formed through the first fixing portion, and a second valve through-hole is formed through the second fixing portion, wherein the first fixing portion is fixed to the retainer block by a first fastening member inserted through the first valve through-hole, and the second fixing portion is fixed to the retainer block by a second fastening member inserted through the second valve through-hole, and wherein fastening member accommodating grooves into which a head of the first fastening member and a head of the second fastening member are inserted are formed in at least one of the block insertion groove or the first axial side surface of the retainer block.

6. The scroll compressor of claim 1, wherein the sealing connection portion includes a discharge communication hole that communicates with the discharge guide hole.

7. The scroll compressor of claim 1, wherein the retainer block is fixed in contact with the rear surface of the non-orbiting scroll and a rear surface of the back pressure chamber assembly facing the non-orbiting scroll by a fastening force that fastens the non-orbiting scroll and the back pressure chamber assembly.

8. The scroll compressor of claim 1, wherein the retainer block is fastened to the rear surface of the back pressure chamber assembly facing the retainer block in an axial direction.

9. The scroll compressor of claim 8, wherein the at least one bypass valve is fastened to the retainer block by a fastening member that fastens the retainer block to the back pressure chamber assembly.

10. A scroll compressor, comprising:

a casing;

an orbiting scroll coupled to a rotary shaft in an inner space of the casing to perform an orbiting motion;

a non-orbiting scroll engaged with the orbiting scroll to define a compression chamber, and provided with a discharge port and a plurality of bypass holes through which refrigerant in the compression chamber is discharged; and a back pressure chamber assembly coupled to a rear surface of the non-orbiting scroll to press the non-orbiting scroll toward the orbiting scroll, wherein a block insertion groove is recessed by a predetermined depth into the rear surface of the non-orbiting scroll to accommodate the discharge port and the plurality of bypass holes therein, and a retainer block having at least one bypass valve that opens and closes the plurality of bypass holes is fixedly inserted into the block insertion groove, wherein the at least one bypass valve is fixed to a first axial side surface of the retainer block facing the block insertion groove, wherein the back pressure chamber assembly includes a valve guide groove formed therein such that a discharge valve is slidably inserted therein, wherein the retainer block includes a discharge valve accommodating portion in which the discharge valve is axially supported, wherein the discharge valve accommodating portion includes the discharge guide hole that communicates with the discharge port, and wherein the discharge valve is disposed between the back pressure chamber assembly and the retainer block to open and close the discharge guide hole.

11. A scroll compressor, comprising:

a casing;

an orbiting scroll coupled to a rotary shaft in an inner space of the casing to perform an orbiting motion;

a non-orbiting scroll engaged with the orbiting scroll to define a compression chamber, and provided with a discharge port and a plurality of bypass holes through which refrigerant in the compression chamber is discharged; and a back pressure chamber assembly coupled to a rear surface of the non-orbiting scroll to press the non-orbiting scroll toward the orbiting scroll, wherein a block insertion groove is recessed by a predetermined depth into the rear surface of the non-orbiting scroll to accommodate the discharge port and the plurality of bypass holes therein, and a retainer block having at least one bypass valve that opens and closes the plurality of bypass holes is fixedly inserted into the block insertion groove, wherein the at least one bypass valve is fixed to a first axial side surface of the retainer block facing the block insertion groove, wherein the back pressure chamber assembly includes a valve guide groove in which a discharge valve is slidably inserted, wherein the retainer block includes a discharge valve accommodating portion through which the discharge valve is inserted, and wherein the discharge valve is inserted through the discharge valve accommodating portion to come into contact with the non-orbiting scroll, so as to open and close the discharge port.

12. A scroll compressor, comprising:

a casing;

an orbiting scroll coupled to a rotary shaft in an inner space of the casing to perform an orbiting motion;

a non-orbiting scroll engaged with the orbiting scroll to define a compression chamber, and provided with a discharge port and a plurality of bypass holes through which refrigerant in the compression chamber is discharged; and a back pressure chamber assembly coupled to a rear surface of the non-orbiting scroll to press the non-orbiting scroll toward the orbiting scroll, wherein a block insertion groove is recessed by a predetermined depth into the rear surface of the non-orbiting scroll to accommodate the discharge port and the plurality of bypass holes therein, and a retainer block having at least one bypass valve that opens and closes the plurality of bypass holes is fixedly inserted into the block insertion groove, wherein the at least one bypass valve is fixed to a first axial side surface of the retainer block facing the block insertion groove, wherein a discharge valve that opens and closes the discharge port is disposed between the block insertion groove and the first axial side surface of the retainer block facing the block insertion groove, wherein the discharge valve is fastened to the first axial side surface of the retainer block facing the block insertion groove, wherein a bypass valve support that supports the at least one bypass valve and a discharge valve support that supports the discharge valve are formed on the first axial side surface of the retainer block that faces the block insertion groove, and wherein the discharge valve support is deeper than the bypass valve support.

13. The scroll compressor of claim 12, wherein the discharge valve is formed integrally with the at least one bypass valve.

14. The scroll compressor of claim 13, wherein the at least one bypass valve comprises:

a plurality of bypass valves spaced apart from each other; and a valve connection portion that connects the plurality of bypass valves, and wherein the discharge valve includes a discharge valve that extends integrally from the valve connection portion.

15. The scroll compressor of claim 12, wherein the discharge valve is provided independently of the at least one bypass valve.

16. A scroll compressor, comprising:

a casing;

an orbiting scroll coupled to a rotary shaft in an inner space of the casing to perform an orbiting motion;

a non-orbiting scroll engaged with the orbiting scroll to define a compression chamber, and provided with a discharge port and a plurality of bypass holes through which refrigerant in the compression chamber is discharged; and a back pressure chamber assembly coupled to a rear surface of the non-orbiting scroll to press the non-orbiting scroll toward the orbiting scroll, wherein a block insertion groove is recessed by a predetermined depth into the rear surface of the non-orbiting scroll to accommodate the discharge port and the plurality of bypass holes therein, and a retainer block having at least one bypass valve that opens and closes the plurality of bypass holes is fixedly inserted into the block insertion groove, wherein the retainer block is fastened to the rear surface of the back pressure chamber assembly facing the retainer block in an axial direction, and wherein the at least one bypass valve is fastened to the retainer block by a fastening member that fastens the retainer block to the back pressure chamber assembly.

* * * * *